US008434848B2

(12) United States Patent
Sakakibara et al.

(10) Patent No.: US 8,434,848 B2
(45) Date of Patent: May 7, 2013

(54) IMAGE FORMING DEVICE AND IMAGE FORMING METHOD

(75) Inventors: Shigetaka Sakakibara, Kanagawa (JP); Takayuki Ito, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 220 days.

(21) Appl. No.: 12/912,815

(22) Filed: Oct. 27, 2010

(65) Prior Publication Data

US 2011/0102489 A1 May 5, 2011

(30) Foreign Application Priority Data

Oct. 30, 2009 (JP) ..... 2009-251037

(51) Int. Cl.
*B41J 29/38* (2006.01)

(52) U.S. Cl.
USPC ..... 347/16; 347/104; 347/5

(58) Field of Classification Search ..... 347/104, 347/16, 5
See application file for complete search history.

(56) References Cited

U.S. PATENT DOCUMENTS 5,124,720 A * 6/1992 Schantz ..... 347/19
6,250,734 B1 * 6/2001 Otsuki ..... 347/16
6,315,383 B1 * 11/2001 Sarmast et al. ..... 347/19
7,118,191 B2 * 10/2006 Fagan et al. ..... 347/41
2004/0207685 A1 * 10/2004 Otsuki ..... 347/40

FOREIGN PATENT DOCUMENTS

| | | |
|---|---|---|
| JP | 2001-171151 | 6/2001 |
| JP | 2004-106392 | 4/2004 |
| JP | 2005-088467 | 4/2005 |
| JP | 2005-305959 | 11/2005 |
| WO | WO 2006/013764 | 2/2006 |

* cited by examiner

*Primary Examiner* — Julian Huffman
*Assistant Examiner* — Sharon A Polk
(74) *Attorney, Agent, or Firm* — Ipusa, PLLC

(57) ABSTRACT

An image forming device forms an image on a recording sheet by bidirectional recording. In the image forming device, a control part controls the image forming device. The control part includes a distance changing part that changes a sheet transporting distance for transporting the recording sheet after a forward movement of a recording head to a first transport distance and changes a sheet transporting distance for transporting the recording sheet after a backward movement of the recording head to a second transport distance, and a nozzle changing part that determines inactive nozzles which do not discharge a recording liquid among nozzles of the recording head alternately for one of the forward movement and the backward movement of the recording head.

7 Claims, 23 Drawing Sheets

IMAGE FORMING DEVICE AND IMAGE FORMING METHOD

BACKGROUND OF THE INVENTION

1. Field of the Invention

The present disclosure relates to an image forming device and an image forming method which are adapted to discharge a recording liquid to a recording sheet to form an image on the recording sheet.

2. Description of the Related Art

Conventionally, in order to speed up image formation processing in an image forming device, such as an ink-jet printing device, a bidirectional printing in which ink is discharged in both a forward path and a backward path parallel to a main scanning direction (which is perpendicular to a transporting direction of a sheet) has been used. However, when the bidirectional printing is performed in such an image forming device, there is a problem that color banding (or color irregularity) in a sub-scanning direction (which is perpendicular to the main scanning direction) may arise. Various image forming devices have been proposed in order to solve this problem.

Japanese Laid-Open Patent Publication No. 2004-106392 discloses an ink-jet printer in which color nozzles of a printing head are arranged in the nozzle row direction, and bidirectional color deviation is reduced by unifying the impact sequence of the nozzles to discharge color ink in the forward and backward directions. The speed of black monochrome printing is increased by using black nozzles arranged in the head independently of the color nozzles.

Japanese Laid-Open Patent Publication No. 2001-171151 discloses an ink-jet printer in which the impact sequence of color-nozzle multiple heads in the bidirectional printing is unified by selectively using one of the multiple heads for the forward path in the main scanning direction and the multiple heads for the backward path in the main scanning direction.

Japanese Laid-Open Patent Publication No. 2005-305959 discloses an ink-jet printing head in which two groups of color nozzles are arranged symmetrically and arrayed side by side with each other in the sub-scanning direction in order to unify the impact sequence of the nozzles and increase the speed of image formation.

However, each of the ink-jet printer of Japanese Laid-Open Patent Publication No. 2004-106392 and the ink-jet printer of Japanese Laid-Open Patent Publication No. 2001-171151 requires a complicated printing head structure or multiple printing heads. As for the ink-jet printing head of Japanese Laid-Open Patent Publication No. 2005-305959, it is difficult to unify the impact sequence of the color nozzles completely for both the forward path and the backward path in the main scanning direction, and color banding may arise.

SUMMARY OF THE INVENTION

In one aspect, the present disclosure provides an image forming device and an image forming method which are capable of efficiently eliminating color banding in the bidirectional printing using a simple printing head structure.

In an embodiment which solves or reduces one or more of the above-mentioned problems, the present disclosure provides an image forming device which forms an image on a recording sheet by bidirectional recording, the image forming device including: a sheet transporting device that transports a recording sheet in a sheet transporting direction; a recording head including multiple head units of different colors, each head unit having nozzles arranged to discharge a recording liquid of one of the colors; a head moving device that moves the recording head along a forward path and a backward path parallel to a direction perpendicular to the sheet transporting direction to form an image on the recording sheet using some of the nozzles of each head unit of the recording head; and a control part that controls the image forming device, the control part including: a distance changing part configured to change a sheet transporting distance for transporting the recording sheet after a forward movement of the recording head to a first transport distance and configured to change a sheet transporting distance for transporting the recording sheet after a backward movement of the recording head to a second transport distance; and a nozzle changing part configured to determine inactive nozzles which do not discharge the recording liquid, among the nozzles of the recording head alternately for one of the forward movement and the backward movement of the recording head.

Other objects, features and advantages of the present disclosure will become more apparent from the following detailed description when read in conjunction with the accompanying drawings.

DETAILED DESCRIPTION OF THE PREFERRED EMBODIMENTS

A description will be given of embodiments of the present disclosure with reference to the accompanying drawings.

In the following, an image forming device may be a printer, a facsimile device, a copying device, a plotter, or a multi-function peripheral (MFP) having the functions of the printer, facsimile device and copying device. For example, the image forming device may be an ink-jet printing device which use an ink-jet printing head. The ink-jet printing device makes an image formation on a recording sheet by discharging ink from the ink-jet printing head onto a recording sheet. The recording sheet may be paper, OHP film or any other suitable recording sheet onto which ink or a recording liquid may be adhered. The image formation includes various kinds of recording and printing of characters, images and/or photographs. A recording liquid suitably used by the image forming device is not limited to ink. Alternatively, the recording liquid used by the image forming device may be a DNA sample, a resist, a pattern material, or a toner.

Figure 1:
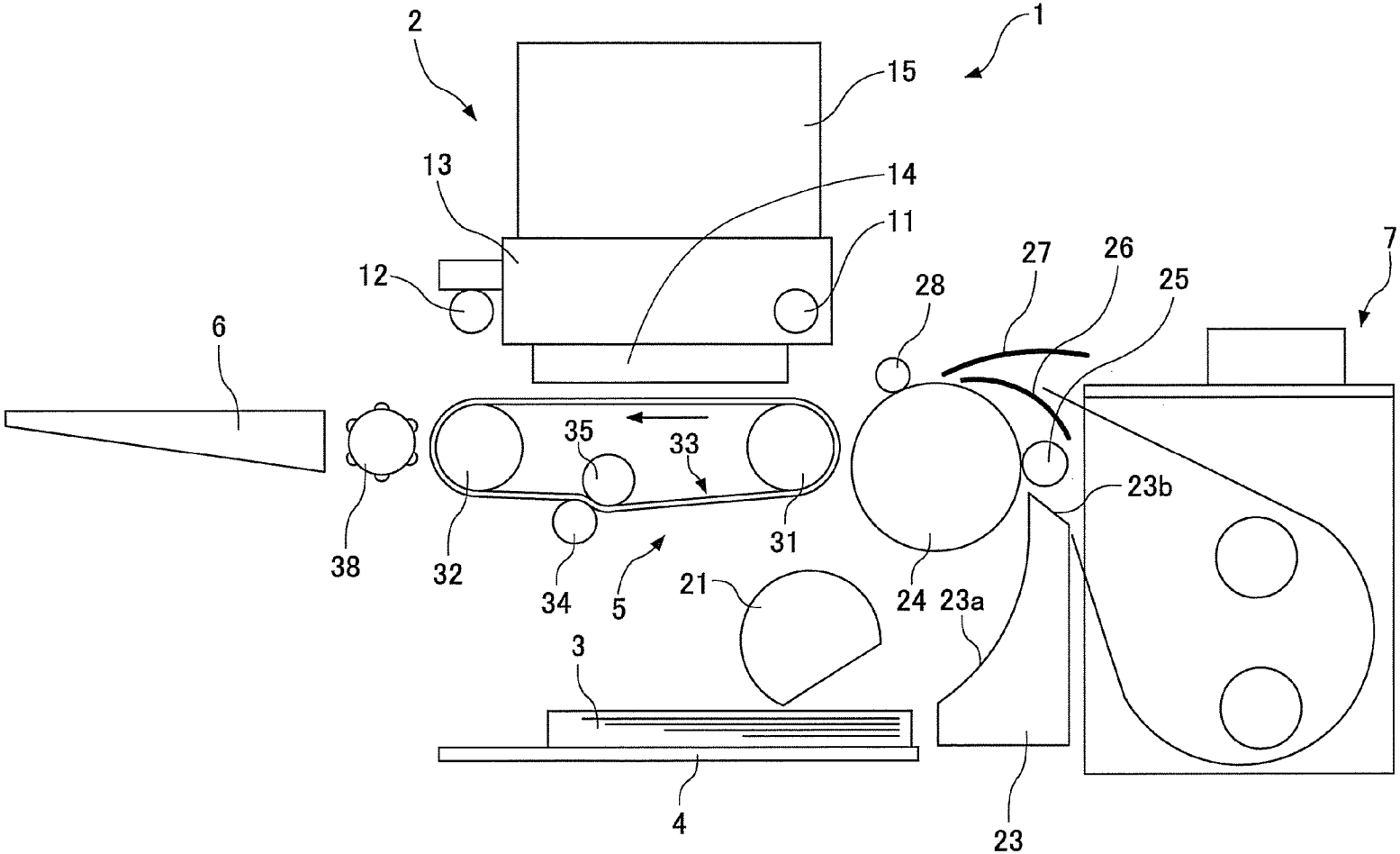
FIG. 1 is a cross-sectional view illustrating the composition of an image forming device of an embodiment of the present disclosure.

FIG. 1 is a cross-sectional view illustrating the composition of an image forming device of an embodiment of the present disclosure.

As illustrated in FIG. 1, the image forming device is made up of a main device body 1 which includes therein an image forming part 2 and the like. A paper supply tray 4 is provided on a lower side of the main device body 1 and a plurality of recording media (which will be simply referred to as recording sheets) 3 can be stacked on this paper supply tray 4. The recording sheet 3 supplied from the paper supply tray 4 is transported by a transporting device 5. The image forming part 2 records an image on the recording sheet 3 that is transported by the transporting device 5, and the recording sheet 3 is thereafter discharged onto a paper eject tray 6 that is provided on a side of the main device body 1.

A duplex unit 7 is detachably provided with respect to the main device body 1 of the image forming device. When carrying out a duplex recording, after the image is recorded on one side (or front surface) of the recording sheet 3, the paper is transported in a reverse direction by the transporting device 5 and supplied into the duplex unit 7 which turns over the recording sheet 3 so that the recording can be made on the other side (or back surface) of the recording sheet 3. The recording sheet 3 is then supplied again to the transporting device 5, and after the image is recorded on the other side (or back surface) of the recording sheet 3 by the image forming part 2, the recording sheet 3 is finally ejected onto the paper eject tray 6.

The image forming part 2 includes a carriage 13 that is slidably supported by guide shafts 11 and 12 and is moved in a main scanning direction that is perpendicular to the transport direction of the recording sheet 3 by a main-scan motor (not illustrated). A printing head 14 is mounted on the carriage 13. The printing head 14 is formed by a plurality of ink-jet heads 14*y*, 14*m*, 14*c* and 14*k* respectively having a plurality of nozzles 14*n* from which the ink drops are discharged. An ink cartridge 15 which supplies the ink to the printing head 14 is detachably provided on the carriage 13. A sub tank (not illustrated) may be provided in place of the ink cartridge 15, and in this case, the ink from a main tank (not illustrated) is supplied to the sub tank.

Figure 3A:
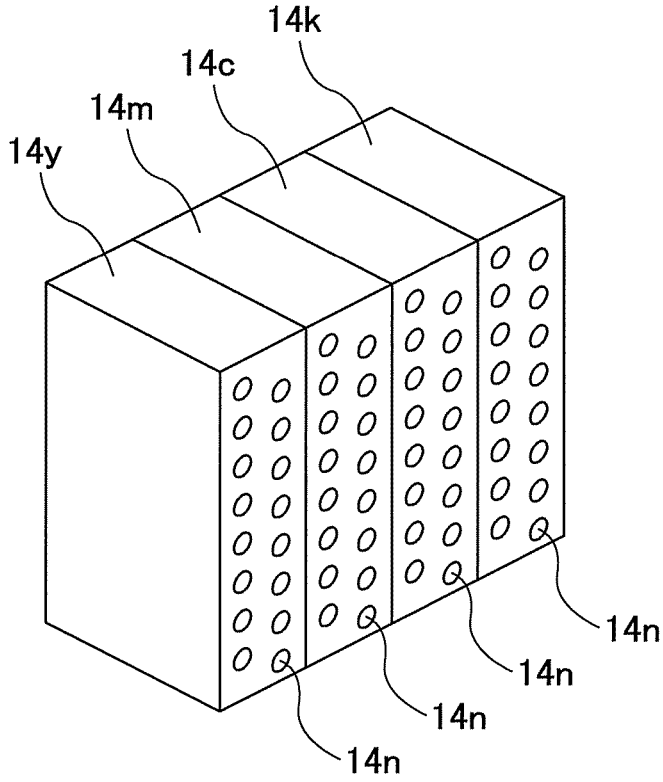
FIG. 3A is a perspective view of a printing head in which nozzles are arranged in a staggered formation.
Figure 3B:
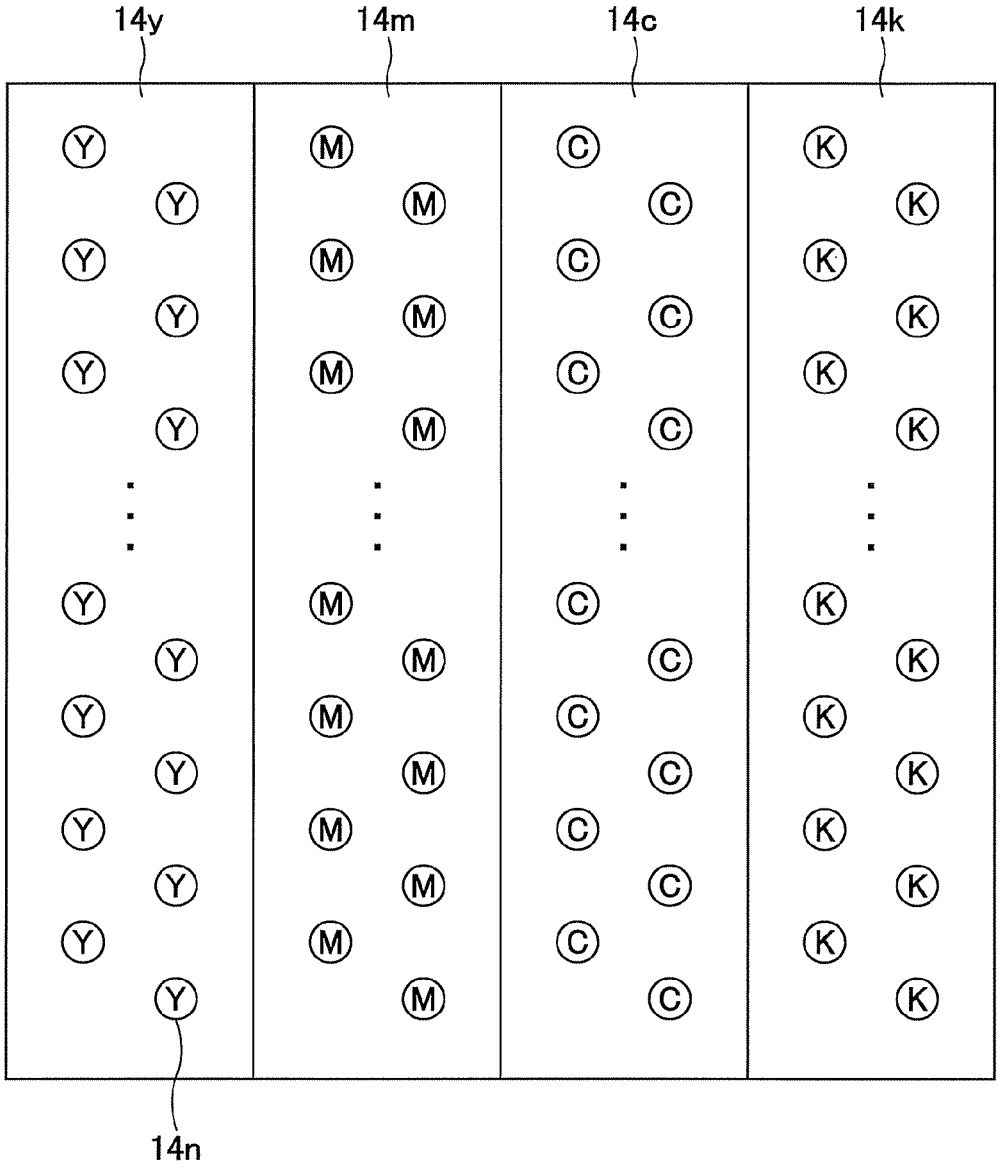
FIG. 3B is a front view of a printing head in which nozzles are arranged in a staggered formation.

As illustrated in FIG. 3A or FIG. 3B, the printing head 14 in the image forming device of the present embodiment is arranged so that the nozzles 14*n* of each of the ink-jet heads 14*y*, 14*m*, 14*c* and 14*k* are arranged in a staggered formation.

Figure 3C:
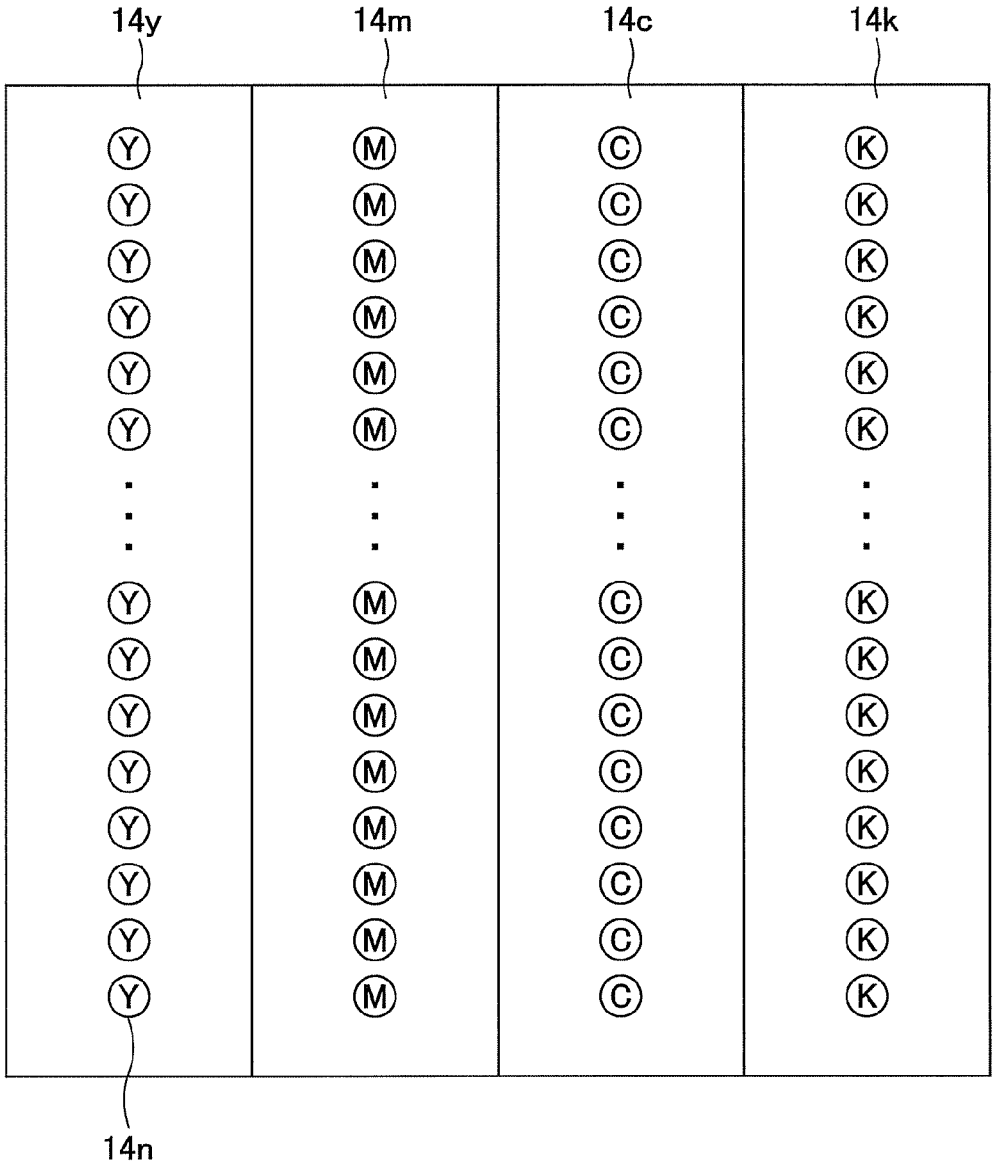
FIG. 3C is a front view of a printing head in which nozzles are arranged in a straight-line formation.

Alternatively, the printing head 14 may be arranged so that the nozzles 14*n* of each of the ink-jet heads 14*y*, 14*m*, 14*c* and 14*k* are arranged in a straight-line formation as illustrated in FIG. 3C.

Figure 2:
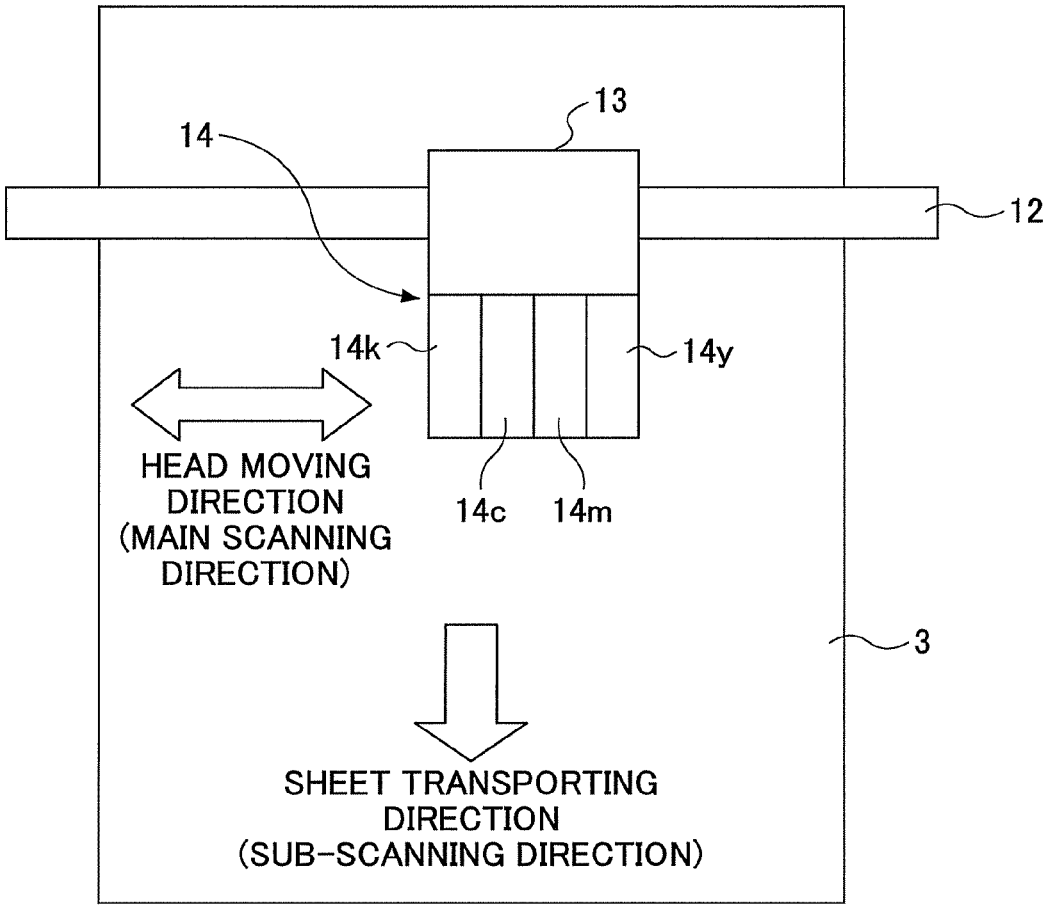
FIG. 2 is a plan view of an image forming part in the image forming device of the present embodiment.

The four independent ink-jet heads 14*y*, 14*m*, 14*g* and 14*k* which form the printing head 14 respectively discharge yellow (Y), magenta (M), cyan (C) and black (K) ink drops, as illustrated in FIG. 2 and FIG. 3A, for example. Of course, the printing head 14 may be formed by one or a plurality of independent ink-jet heads, as long as one or a plurality of rows of nozzles are provided for discharging the ink of each of the different colors. The number of colors used and the order in which the four ink-jet heads 14*y*, 14*m*, 14*c* and 14*k* are arranged are not limited to those illustrated for the present embodiment.

Each ink-jet head forming the printing head 14 may be provided with an energy generating means (or pressure generating means) for discharging the ink, such as a piezoelectric actuator using a piezoelectric element or the like, a thermal actuator which utilizes a phase change caused by a film boiling of the ink using an electro-thermal conversion element such as a heating resistor, a shape memory alloy actuator that utilizes a metallic phase change, and an electrostatic actuator that utilizes electrostatic force.

The recording sheet 3 on the paper supply tray 4 is separated one by one by a paper supply roller (or semicircular roller) 21 and a separation pad (not illustrated). The separated recording sheet 3 is supplied inside the main device body 1, to the transporting device 5.

The transporting device 5 includes a transport guide part 23 for guiding the recording sheet 3 that is supplied via the paper supply roller 21 upwards along a guide surface 23*a* and guides the recording sheet 3 that is supplied from the duplex unit 7 along a guide surface 23*b*, a transport roller 24 for transporting the recording sheet 3, a pressing roller 25 for pressing the recording sheet 3 against the transport roller 24, a guide member 26 for guiding the recording sheet 3 towards the transport roller 24, a guide member 27 for guiding the recording sheet 3 that is returned at the time of the duplex recording to the duplex unit 7, and a pushing roller 28 for pushing against the recording sheet 3 that is transported from the transport roller 24.

The transporting device 5 further includes a transporting belt 33 that is provided between a driving roller 31 and a following roller (or tension roller) 32 and transports the recording sheet 3 while maintaining the recording sheet 3 flat between the printing head 14 and the transporting belt 33, a charging roller 34 for charging the transporting belt 33, a guide roller 35 confronting the charging roller 34, a guide member (or platen plate, not illustrated) for guiding the transporting belt 33 at a portion confronting the image forming part 2, a cleaning means (not illustrated) for cleaning the transporting belt 33 by removing the ink that is adhered on the transporting belt 33, and the like. For example, the cleaning means may be formed by a cleaning roller that is made of a porous material.

The transporting belt 33 is formed by an endless belt that is provided between the driving roller 31 and the following roller 32, and circulates in a direction (or sheet transporting direction) indicated by the arrow in FIG. 1.

Figure 4:
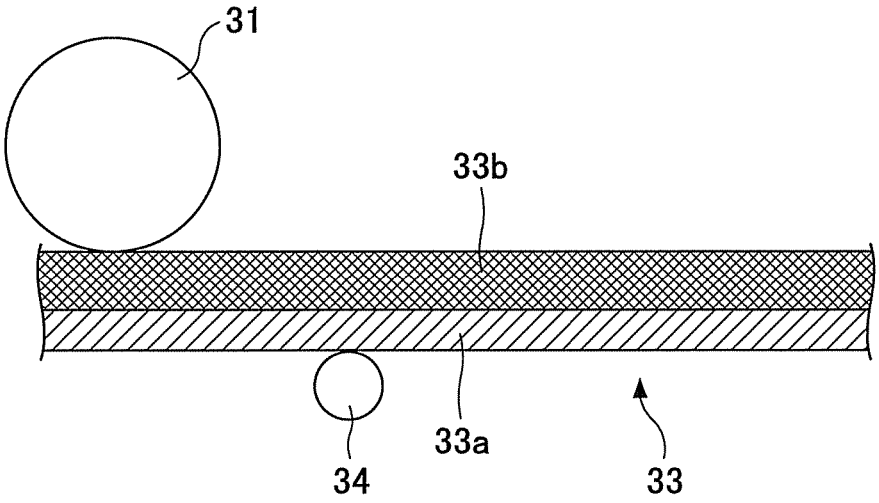
FIG. 4 is a cross-sectional view of an example of a transporting belt.

The transporting belt 33 may have a single-layer structure or multi-layer structure. FIG. 4 shows a case where the transporting belt 33 has a multi-layer structure made up of two layers, namely, a first layer (or surface layer) 33*a* and a second layer (or back layer) 33*b*. However, the transporting belt 33 may have a multi-layer structure made up of three or more layers. For example, the first layer (or surface layer) 33*a* is made of a pure resin material which has not been subjected to a resistance control and has a thickness on the order of 40 micrometers, such as pure ETFE material, and the second layer (or intermediate resistance layer, ground layer) 33*b* is made of the same material as the first layer 33*a* but which has been subjected to a resistance control using carbon.

The charging roller 34 is arranged so as to make contact with the surface layer 33*a* of the transporting belt 33 and rotate to follow the circulating movement of the transporting belt 33. A high voltage having a predetermined pattern is applied to the charging roller 34 from a high voltage circuit (or high voltage source, not illustrated).

A paper eject roller 38 is provided on a downstream side of the transporting device 35. The recording sheet 3 that is recorded with the image by the image forming part 2 is discharged onto the paper eject tray 6 via the paper eject roller 38.

In the image forming device having the structure described above, the transporting belt 33 which circulates in the direction of the arrow in FIG. 1 is charged to a positive polarity by making contact with the charging roller 34 that is applied with a voltage (AC bias voltage) having a high potential. In this case, the polarity of the voltage applied to the charging roller 34 is switched at predetermined time intervals, so that the transporting belt 33 is charged with a polarity that is alternatively switched between positive and negative polarities at a predetermined charging pitch.

When the recording sheet 3 is supplied onto the transporting belt 33 that has been charged to the high potential, the inside of the recording sheet 3 assumes a polarized state, and a charge having a polarity opposite to that on the transporting belt 33 is induced on the surface of the recording sheet 3 in contact with the transporting belt 33. As a result, the charge on the transporting belt 33 and the charge induced on the surface of the recording sheet 3 are electrostatically attracted to each other, and the recording sheet 3 is electrostatically adhered on the transporting belt 33. Hence, the warp and unevenness of the recording sheet 3 are corrected by being strongly adhered on the transporting belt 33, thereby forming a highly flat surface of the recording sheet 3 on the transporting belt 33.

Figure 5A:
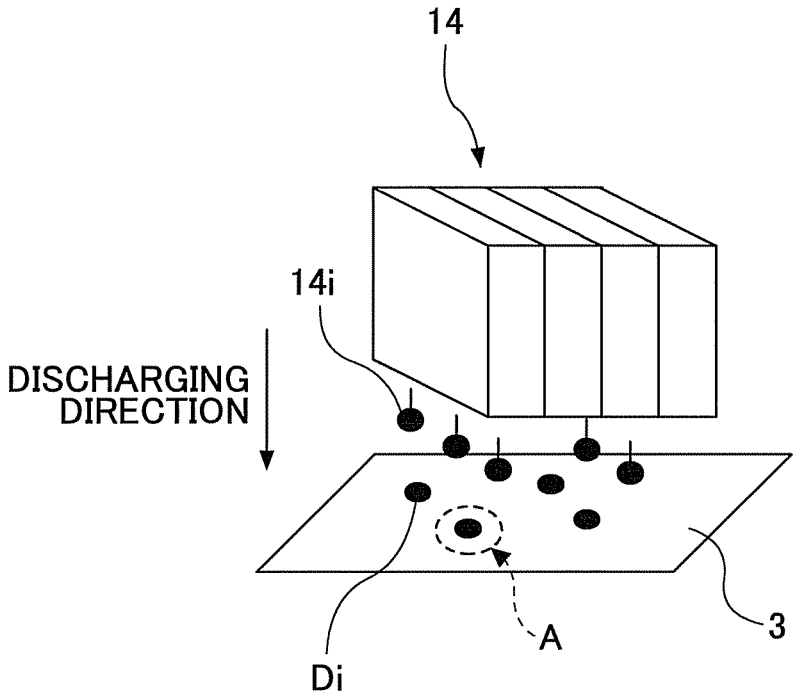
FIG. 5A and FIG. 5B are diagrams illustrating a recording sheet to which ink drops are discharged from a printing head.
Figure 5B:
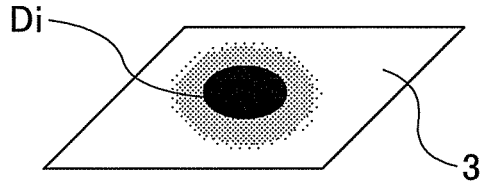

The transporting belt 33 circulates to move the recording sheet 3, and the printing head 14 is driven in response to an image signal while the carriage 13 moves and scans in one direction (or down-path) to make a one-way recording or in two directions (or forward path and backward path) to make a bidirectional printing. Hence, as illustrated in FIG. 5A and FIG. 5B, ink drops 14*i* are discharged (or sprayed) from the printing head 14 and form dots Di on the stationary recording sheet 3. After forming the dots Di amounting to 1 line, the recording sheet 3 is transported by a predetermined amount, and the next line is then recorded on the recording sheet 3. The print operation ends in response to a printing end signal or a signal indicating that a rear end (or trailing end) of a recording region on the recording sheet 3 is reached. FIG. 5B is an enlarged view of the dot Di forming portion indicated by the character A in FIG. 5A.

The recording sheet 3 having the image recorded thereon in the above described manner is discharged onto the paper eject tray 6 by the paper eject roller 38.

In this embodiment, the image forming device uses the printing head 14 that uses four colors, that is, the ink-jet heads 14*y*, 14*m*, 14*c* and 14*k*. However, the printing head 14 is not limited to the 4-color head structure. For example, the printing head 14 may have a 6-color head structure or a 7-color head structure. Of course, the colors and the order in which the colors are arranged in each of these head structures are not limited to the illustrated embodiment.

Figure 6:
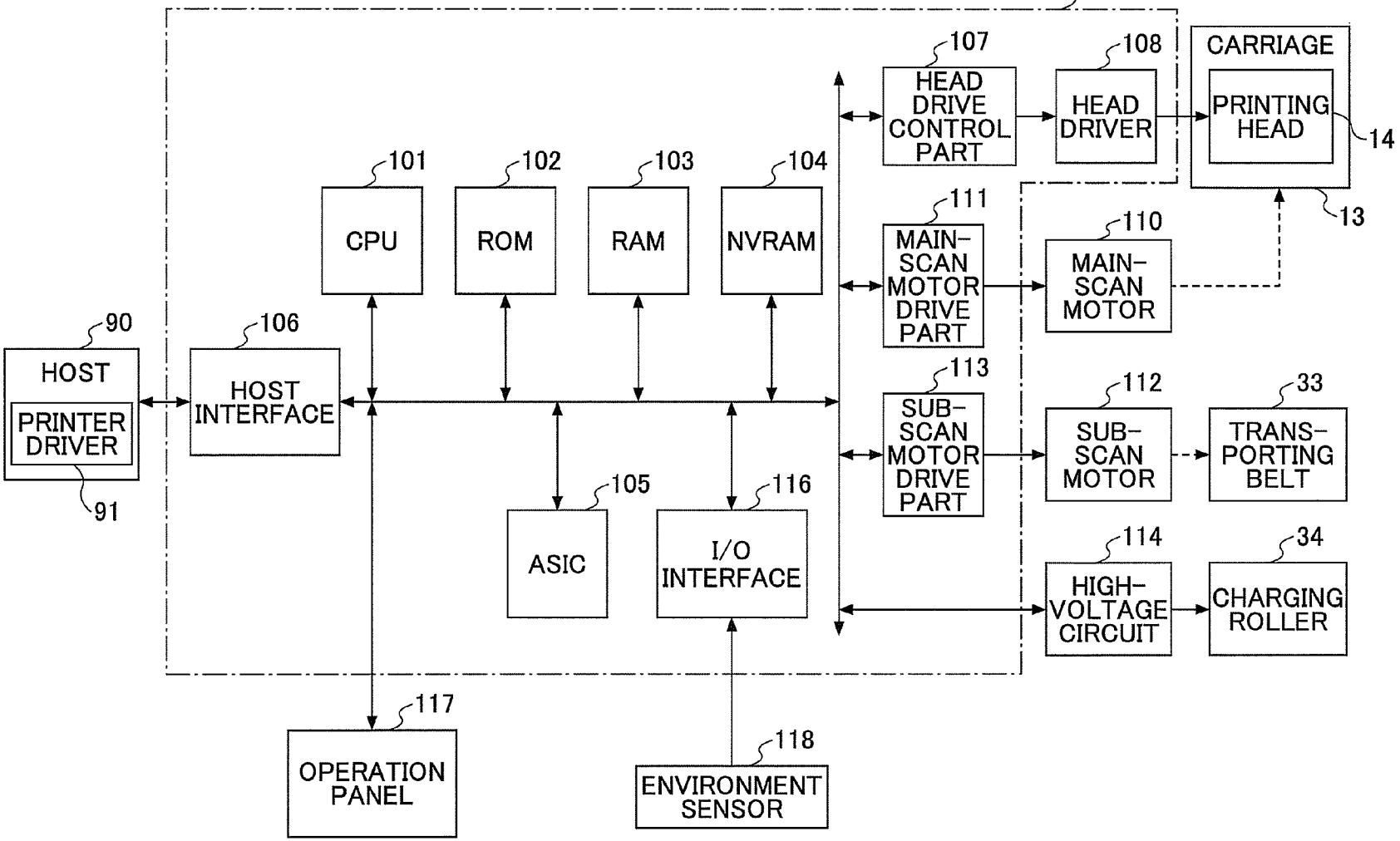
FIG. 6 is a diagram illustrating the functional composition of a control part in the image forming device of the present embodiment.

Next, FIG. 6 is a diagram illustrating the functional composition of a control part in the image forming device of the present embodiment.

A control part 100 illustrated in FIG. 6 includes a CPU 101 that controls the entire image forming device, a ROM 102 that stores programs to be executed by the CPU 101 and other fixed data, a RAM 103 that temporarily stores image data and the like, a non-volatile memory (NVRAM) 104 that holds data even when the power of the image forming device is OFF, and an ASIC 105 that carries out various kinds of signal processing, image processing such as rearrangement, and other processing including processing of input and output signals for controlling the entire image forming device.

The control part 100 further includes a host interface (I/F) 106, a head drive control part 107, a head driver 108, a main-scan motor drive part 111 for driving a main-scan motor 110, a sub-scan motor drive part 113 for driving a sub-scan motor 112, a high-voltage circuit 114 for supplying an AC bias to the charging roller 34, an environment sensor (or sensor unit) 118, and an input/output (I/O) interface 116. The host interface 106 exchanges data and signals between the control part 100 and a host 90, such as a personal computer. The head drive control part 107 generates a driving waveform for driving and controlling the printing head 14 via the head driver 108. The environment sensor 118 detects the environment temperature and/or the environment humidity. The input/output interface 116 inputs detection signals from various kinds of sensors (not illustrated) including the environment sensor 118. An operation panel 117 is connected to the control part 100, so as to input and display information that is necessary to the image forming device.

The control part 100 receives print data and the like, including image data, from the host 90, at the interface 106, via a cable or a network. The host 90 may be made up of a personal computer or the like, and forms an image processing device such as a data processing device, an image reading device such as an image scanner, and an image pickup device such as a digital camera. The print data with respect to the control part 100 is generated by a printer driver 91 of the host 90.

The CPU 101 reads and analyzes the print data within a reception buffer that is included in the host interface 106, and after carrying out a data rearranging process and the like in the ASIC 105, transfers the image data to a head driving control part that is formed by the head drive control part 107 and the head driver 108. The conversion of the print data to the bit-map data for the purpose of outputting the image is carried out by the printer driver 91 which develops the print data into the bit-map data and transfers the print data (bit-map data) from the host 90 to the control part 100. However, it is of course possible to store font data in the ROM 102, for example.

The head drive control part 107 includes a digital-to-analog converter (DAC) for subjecting the pattern data of the driving pulses to a digital-to-analog conversion and outputting with respect to the head driver 108 a driving waveform that is made up of a single driving pulse (driving signal) or a plurality of driving pulses (driving signals).

The head driver 108 drives the printing head 14 by selectively applying the driving pulses forming the driving waveform that is received from the head drive control part 107 to the pressure generating means of the printing head 14, based on the serially input image data (dot pattern data) amounting to 1 line of the printing head 14. For example, the head driver 108 includes a shift register for inputting a clock signal and the serial data, a latch circuit for latching the register value of the shift register in response to a latch signal, a level converting circuit (or level shifter) for converting a level of the output value of the latch circuit, an analog switch array (or switching means) that is controlled to turn ON/OFF by the level converting circuit, and the like. In this case, the printing head 14 can be driven by selectively applying a predetermined driving waveform included in the driving waveform from the head drive control part 107 to the pressure generating means of the printing head 14, by controlling the ON/OFF state of the analog switch array. In this embodiment, the driving waveform is made up of a plurality of driving pulses, and one or a plurality of driving pulses are applied to the pressure generating means of the printing head 14 so that the printing head 14 outputs a large ink drop, a medium ink drop, a small ink drop or no ink drop, in order to reproduce 4 kinds of gradation levels.

The image forming device according to the present disclosure may be arranged to perform a printing operation without providing a margin in an end portion of a recording sheet. When printing of an end portion of a recording sheet is performed, the ink will be discharged off the range of the recording sheet. Even if the ink is discharged to print an image to the end of the recording sheet, in many cases, the ink actually cannot be made to reach the ideal impact position due to the transport distance error of the transporting system of the recording sheet or the driving error of the carriage, and a margin in the end of the recording sheet will arise.

Hence, the printing is performed to make the printing range wider than the ideal printing range so as to include an error of the printing position therein, and the ink will be discharged off the range of the recording sheet. The ink discharged off the range of the recording sheet at this time is extra ink that is not used in the printing. To eliminate the problem, it is necessary to reduce the amount of extra ink as much as possible.

A conceivable method of reducing the amount of extra ink is to increase the transporting precision of a recording sheet. By increasing the transporting precision and decreasing the extra area of the recording sheet where extra ink is discharged, it is possible to reduce the amount of extra ink. Specifically, when printing of an end portion of a recording sheet is performed, the transporting amount of the recording sheet may be changed to a very small amount in order to increase the transporting precision.

Figure 7:
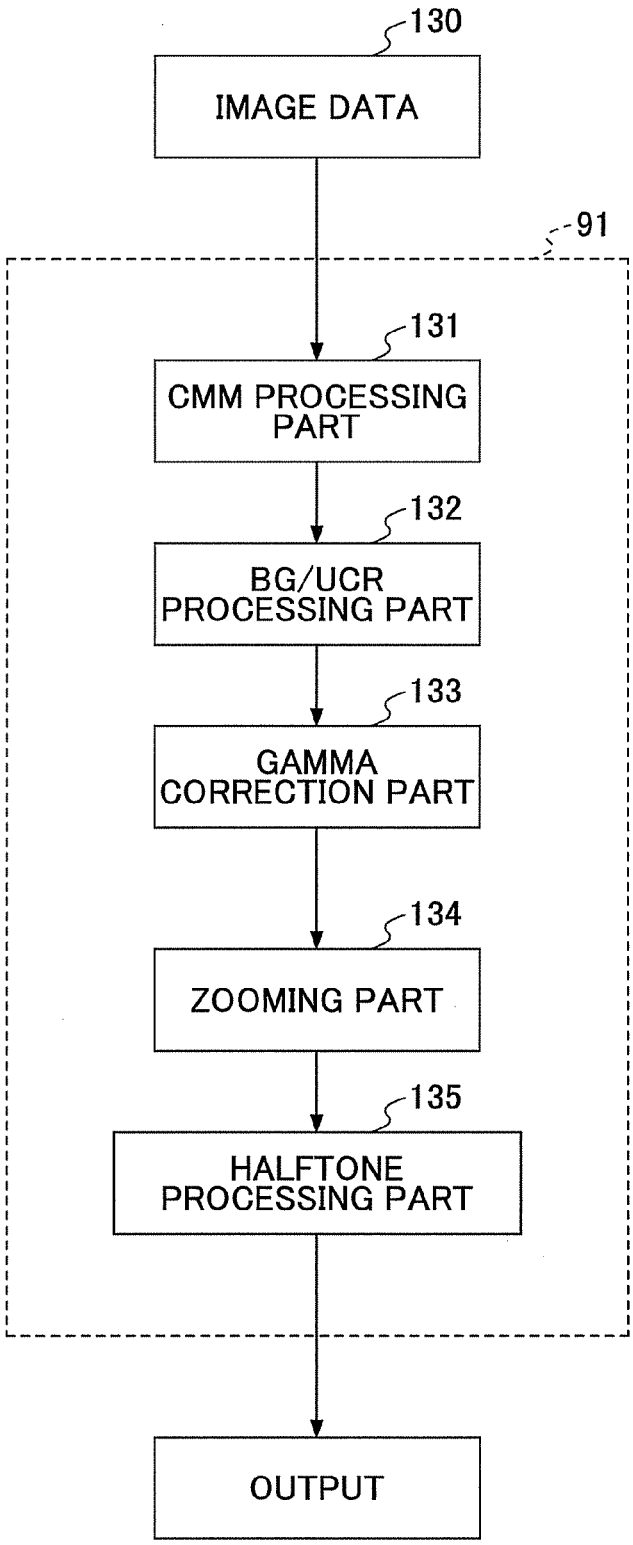
FIG. 7 is a diagram illustrating the functional composition of a printer driver in the image forming device of the present embodiment.

Next, FIG. 7 is a diagram illustrating the functional composition of a printer driver in the image forming device of the present embodiment.

The printer driver 91 of the host 90 includes parts 131 through 135 as illustrated in FIG. 7, and processes image data 130 into output image data. The color management module (CMM) processing part 131 transforms the image data 130 obtained from an application software or the like from a color space for the monitoring display into a color space for the image forming device, to make a transformation from an RGB colorimetric system into a CMY colorimetric system. The black generation/under color removal (BG/UCR) processing part 132 carries out a black generation and an under color removal based on the CMY value. The gamma correction part 133 carries out an input and output correction which reflects the characteristics of the image forming device and the preferences of the user. The zooming part 134 restricts the total quantity of data. The halftone processing part 135 includes a dither matrix and replaces the image data by a dot pattern arrangement that is to be output and recorded by the image forming device. An output of the halftone processing part 135 is supplied to the host interface 106 of the image forming device as the image data.

Next, a case in which ink drops of different colors are discharged onto a recording sheet in a superimposing manner will be described by referring to FIGS. 8A-8C.

Figure 8A:
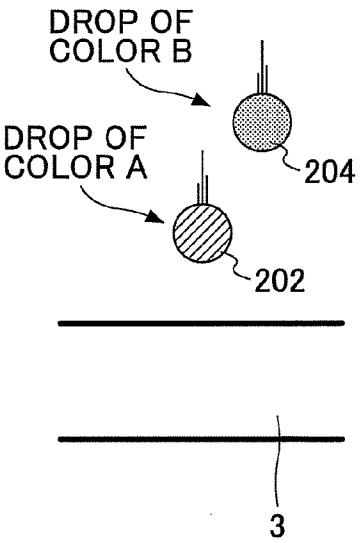
FIG. 8A, FIG. 8B, and FIG. 8C are diagrams for explaining a case where ink drops of different colors are discharged onto a recording sheet in a superimposing manner.
Figure 8B:
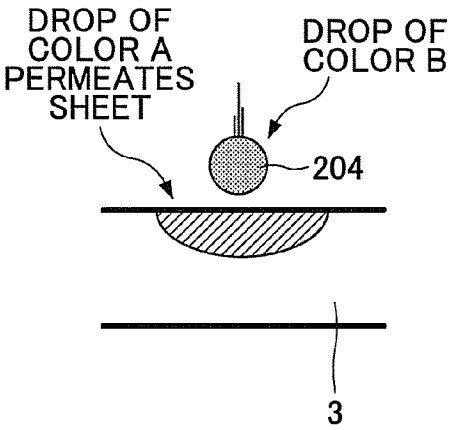
Figure 8C:
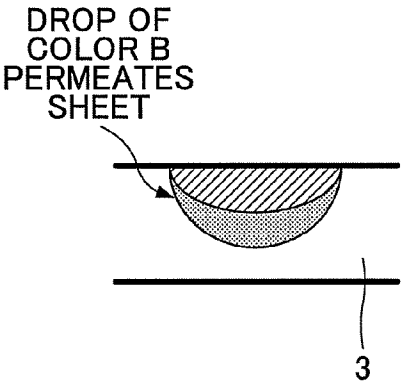

FIGS. 8A-8C are diagrams for explaining the case in which ink drops of different colors are discharged onto a recording sheet in a superimposing manner. In the example of FIGS. 8A-8C, an ink drop 202 of color A is discharged to reach a recording sheet 3 and, immediately thereafter, an ink drop 204 of color B is discharged to reach the recording sheet 3. In FIGS. 8A-8C, the drop 202 of color A is indicated by the hatching region and the drop 204 of color B is indicated by the dotted region.

As illustrated in FIG. 8A, the drop of color A reaches the recording sheet 3 earlier than the drop of color B. In this case, as illustrated in FIG. 8B, the drop of color A having reached the recording sheet 3 earlier permeates the recording sheet 3 earlier. As illustrated in FIG. 8C, the drop of color B having reached the recording sheet 3 later permeates a portion of the recording sheet 3 under the drop of color A having permeated the recording sheet 3 earlier. In this case, a phenomenon which is specific to the ink-jet color printing occurs as illustrated in FIG. 8C. That is, the phenomenon occurs in such a manner that color A becomes dominant in a mixed color resulting from the mixture of the drop of color A and the drop of color B in the recording sheet 3 if the drop of color A permeates the recording sheet 3 earlier than the drop of color B.

In the case of a pigment ink in which particle-like colorant components are distributed or a color ink containing a color-resin emulsion, apart from a dye ink which is dissolved in ink, the above-described phenomenon is significantly affected by the impact sequence of ink drops.

More specifically, when a red image is to be formed on a recording sheet 3, an ink drop of magenta and an ink drop of yellow are mixed. If the drop of magenta is discharged to reach the recording sheet earlier and then the drop of yellow is discharged to reach the recording sheet later, a red image in which magenta is dominant will be formed because of the above-described phenomenon. Conversely, if the drop of yellow is discharged to reach the recording sheet earlier and then the drop of magenta is discharged to reach the recording sheet later, a red image in which yellow is dominant will be formed because of the above-described phenomenon.

Figure 9B:
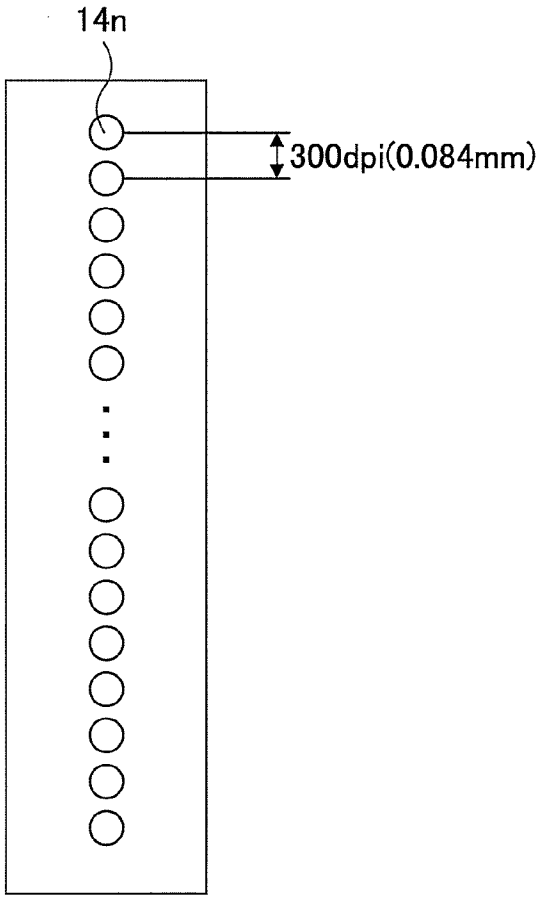
FIG. 9A and FIG. 9B are diagrams for explaining a resolution of nozzles of a printing head.
Figure 9A:
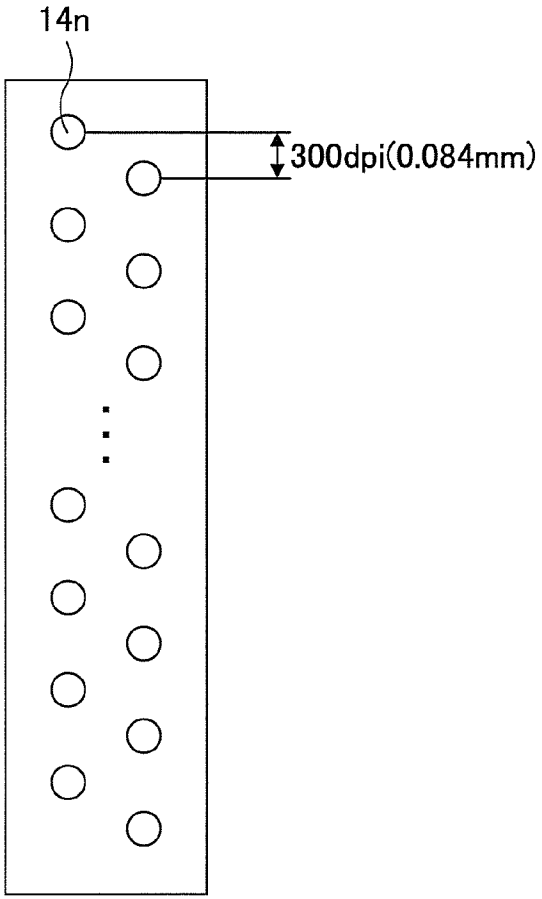

Next, a resolution P of nozzles of a printing head will be described. FIG. 9A is a diagram for explaining a resolution P of nozzles 14*n* of a printing head in which the nozzles 14*n* are arranged in a staggered formation, and FIG. 9B is a diagram for explaining a resolution P of nozzles 14*n* of a printing head in which the nozzles 14*n* are arranged in a straight-line formation.

In the present embodiment, it is assumed that the resolution P of nozzles 14*n* is represented by a distance d in the nozzle array direction between two adjacent ones of the nozzles 14*n* of the printing head. For example, in each of the examples of FIG. 9A and FIG. 9B, the distance d is equal to 0.084 mm and the nozzle resolution is equal to 300 dpi. The resolution of nozzles of the printing head is a value which is predetermined at the time of manufacture of the printing head.

Next, a resolution Q of image formation will be described. The resolution Q of image formation is a value which is determined by a user input on the operation panel 117 (FIG. 6).

In the following, operations to perform image formation on a recording sheet by discharging ink drops from the nozzles 14*n* of the printing head to the recording sheet will be referred to as scans. Discharging ink drops from the nozzles 14*n* once will be called one scan, and discharging ink drops from the nozzles 14*n* twice will be called two scans. When image formation on a recording sheet is performed by one scan, the printing head 14 is moved along a forward path or a backward path in a direction parallel to the main scanning direction (forward movement or backward movement) and the printing head 14 passes through the upper part of the recording sheet while discharging the ink to the recording sheet. When image formation on a recording sheet is performed by two scans, the printing head 14 is moved along forward and backward paths in directions parallel to the main scanning direction (forward and backward movements) and the printing head 14 passes through the upper part of the recording sheet while discharging the ink to the recording sheet in a superimposing manner.

Generally, when the resolution Q of image formation (the value of which is determined beforehand by a user input on the operation panel 117) is equal to or smaller than the nozzle resolution P of the printing head, the image formation is performed by one scan. When the resolution Q of image formation is larger than the nozzle resolution P, the image formation is performed by two or more scans.

In the following, a case in which image formation is performed by two or more scans using the image forming device according to the present disclosure will be described.

Figure 10:
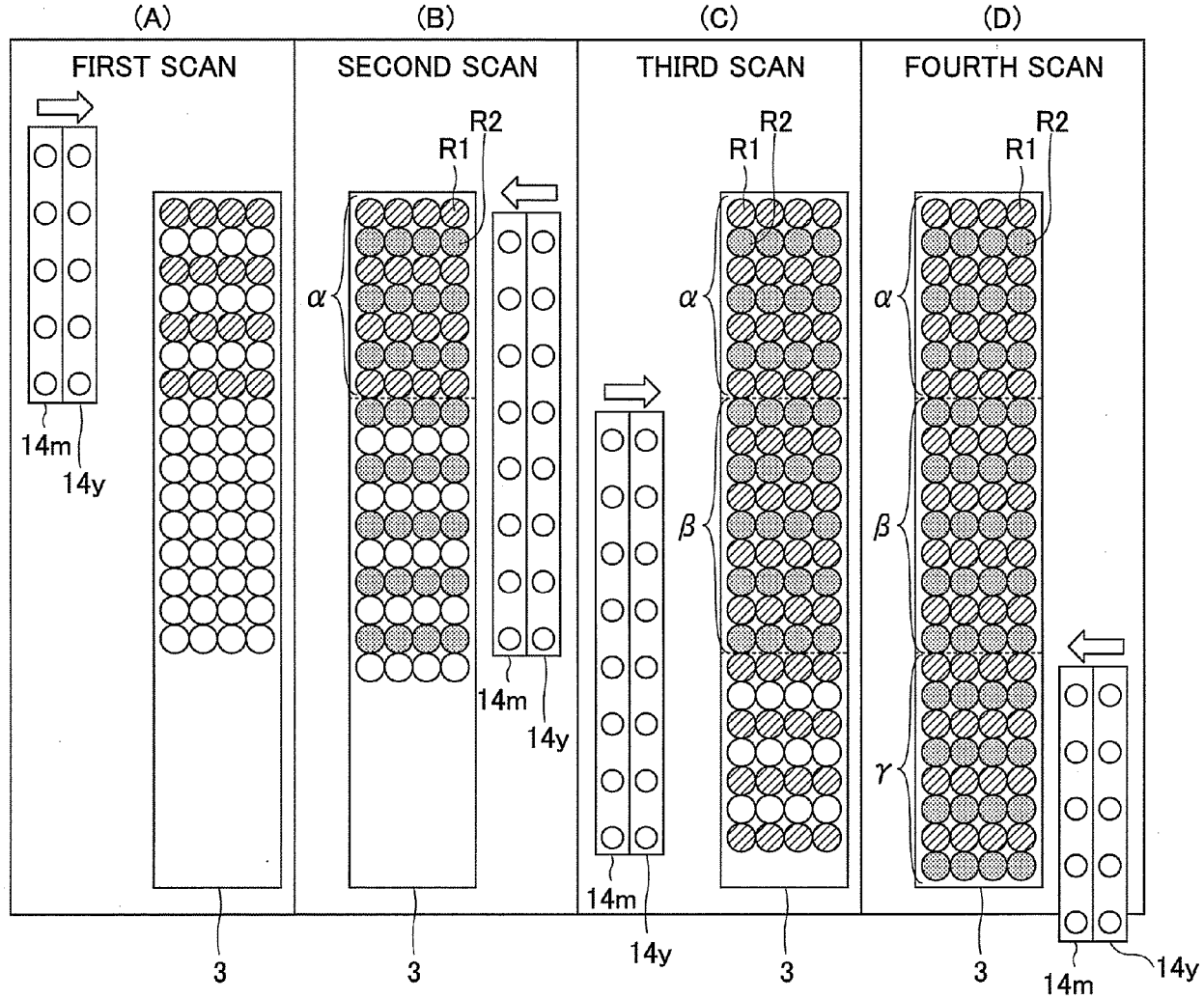
FIG. 10 is a diagram illustrating the impact positions of ink dots when an impact position error does not arise.

Next, a description will be given of an impact sequence error. FIG. 10 illustrates the impact positions of ink dots when an impact position error does not arise. The blocks (A)-(D) of FIG. 10 respectively illustrate the impact positions of ink dots by the first through fourth scans. For the sake of simplicity of description, in the example illustrated in the blocks (A) to (D) of FIG. 10, the printing head 14 includes only the printing head 14*y* of yellow and the printing head 14*m* of magenta.

In practice, the recording sheet 3 is transported in the sub-scanning direction (or the vertical "up" direction on the paper of FIG. 10) and the printing head 14 is not moved in the sub-scanning direction. However, in order to show the positional relationship of the printing head 14 relative to the recording sheet 3, it is illustrated in the blocks (A) to (D) of FIG. 10 as if the printing head 14 was moved in the sub-scanning direction.

The block (A) of FIG. 10 illustrates the way the dots are formed in the recording sheet 3 by the first scan. The block (B) of FIG. 10 illustrates the way the dots are formed in the recording sheet 3 by the second scan. The block (C) of FIG. 10 illustrates the way the dots are formed in the recording sheet 3 by the third scan. The block (D) of FIG. 10 illustrates the way the dots are formed in the recording sheet 3 by the fourth scan.

As illustrated in the block (A) of FIG. 10, the printing head 14*y* is located on the front side in the head moving direction at the time of the first scan, and the ink drop of yellow reaches the recording sheet earlier than the ink drop of magenta. Therefore, the ink dots of red R1 in which yellow is dominant are formed because of the previously described phenomenon. In FIG. 10, each of the ink dots of red R1 in which yellow is dominant are indicated by the hatching region.

Subsequently, as illustrated in the block (B) of FIG. 10, the printing head 14*m* is located on the front side in the head moving direction at the time of the second scan, and the ink drop of magenta reaches the recording sheet earlier than the ink drop of yellow. Therefore, the ink dots of red R2 in which magenta is dominant are formed because of the previously described phenomenon. In FIG. 10, each of the ink dots of red R2 in which magenta is dominant is indicated by the dotted region.

As illustrated in the block (C) of FIG. 10, the ink dots of red R1 in which yellow is dominant are formed by the third scan similar to the first scan described above.

As illustrated in the block (D) of FIG. 10, the ink dots of red R2 in which magenta is dominant are formed by the fourth scan similar to the second scan described above.

In this manner, when an impact position error of the printing head 14 does not arise, ink dots of monochrome red are formed. In this respect, as illustrated in the block (D) of FIG. 10, the ink dot of red R1 in which yellow is dominant and the ink dot of red R2 in which magenta is dominant are alternately formed along the sub-scanning direction. Because one dot is negligibly small to the human eyes it is recognized that these dots are of monochrome red.

In the areas indicated by α and γ in the block (D) of FIG. 10, each of the ink dots of red is formed by the sequence of "the ink dot of red R1 in which yellow is dominant→the ink dot of red R2 in which magenta is dominant". In the area indicated by β in the block (D) of FIG. 10, each of the ink dots of red is formed by the sequence of "the ink dot of red R2 in which magenta is dominant→the ink dot of red R1 in which yellow is dominant". In the following, such a difference in the sequence of ink dots R1 and R2 will be referred to as a difference in the impact sequence.

Figure 11:
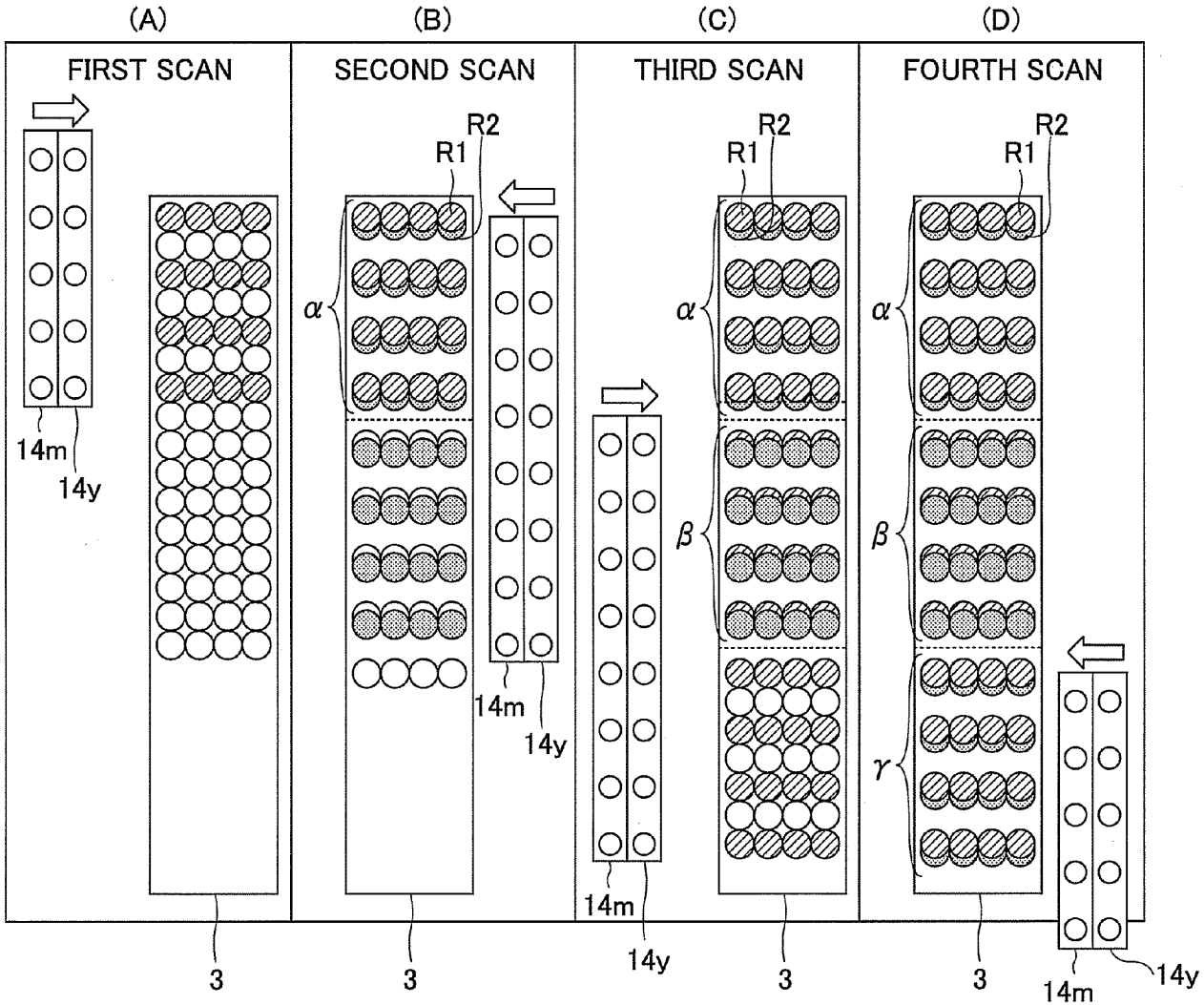
FIG. 11 is a diagram illustrating the impact positions of ink dots when an impact position error arises.

FIG. 11 illustrates the impact positions of ink dots when an impact position error arises. The blocks (A)-(D) of FIG. 11 respectively illustrate the impact positions of ink dots by the first through fourth scans. The impact position error means a difference between the ideal impact position (as illustrated in the blocks (A)-(D) of FIG. 10) and the actual impact position (as illustrated in the blocks (A)-(D) of FIG. 11). As illustrated in the blocks (B)-(D) of FIG. 11, the ink dot formed in the forward movement of the printing head (for example, by the first scan) and the ink dot formed in the backward movement of the printing head (for example, by the second scan) overlap each other when the impact position error arises.

In the areas indicated by α and γ in the block (D) of FIG. 11, each of the ink dots of red is formed by the sequence of "R1→R2" and the ink dots of red R1 in which yellow is dominant are formed in these areas of the recording sheet. On the other hand, in the area indicated by β in the block (D) of FIG. 11, each of the ink dots of red is formed by the sequence of "R2→R1" and the ink dots of red R2 in which magenta is dominant are formed in this area of the recording sheet. Namely, because the areas indicated by α and γ and the area indicated by β have a difference in the impact sequence, the ink dots with different phases of red are formed in such areas. As a result, color banding (or color irregularity) arises.

If an impact position error does not arise and the ideal impact positions as illustrated in the blocks (A)-(D) of FIG. 10 are realized, color banding does not arise. However, in practice, it is very difficult to control the printing head 14 such that the occurrence of an impact position error is avoided.

To eliminate the problem, an image forming device of an embodiment of the present disclosure is arranged to control the impact sequence of ink by the printing head such that the same impact sequence is used for each of multiple scans by the printing head. The image forming device of the present embodiment will be described.

Figure 12:
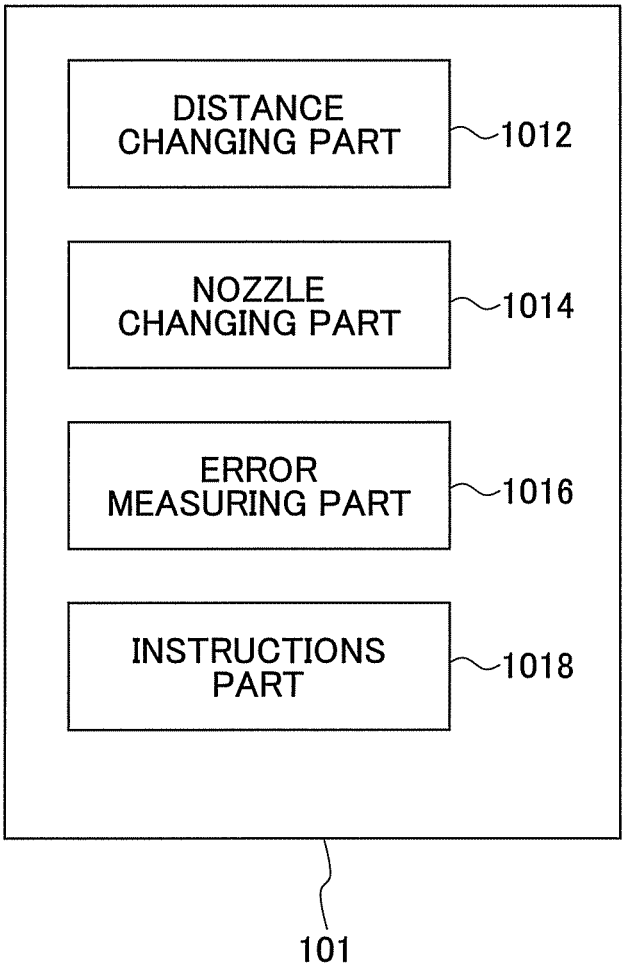
FIG. 12 is a block diagram illustrating the functional composition of a control part of an image forming device of an embodiment of the present disclosure.

FIG. 12 is a diagram illustrating the functional composition of a control part of the image forming device of the present embodiment, which is provided by the CPU 101 in FIG. 6.

As illustrated in FIG. 12, the functions provided by the CPU 101 of the image forming device of this embodiment include a distance changing part 1012, a nozzle changing part 1014, an error measuring part 1016, and an instructions part 1018. The image forming device of this embodiment is arranged so that image formation on a recording sheet is performed using some of a plurality of nozzles of the printing head.

Figure 13:
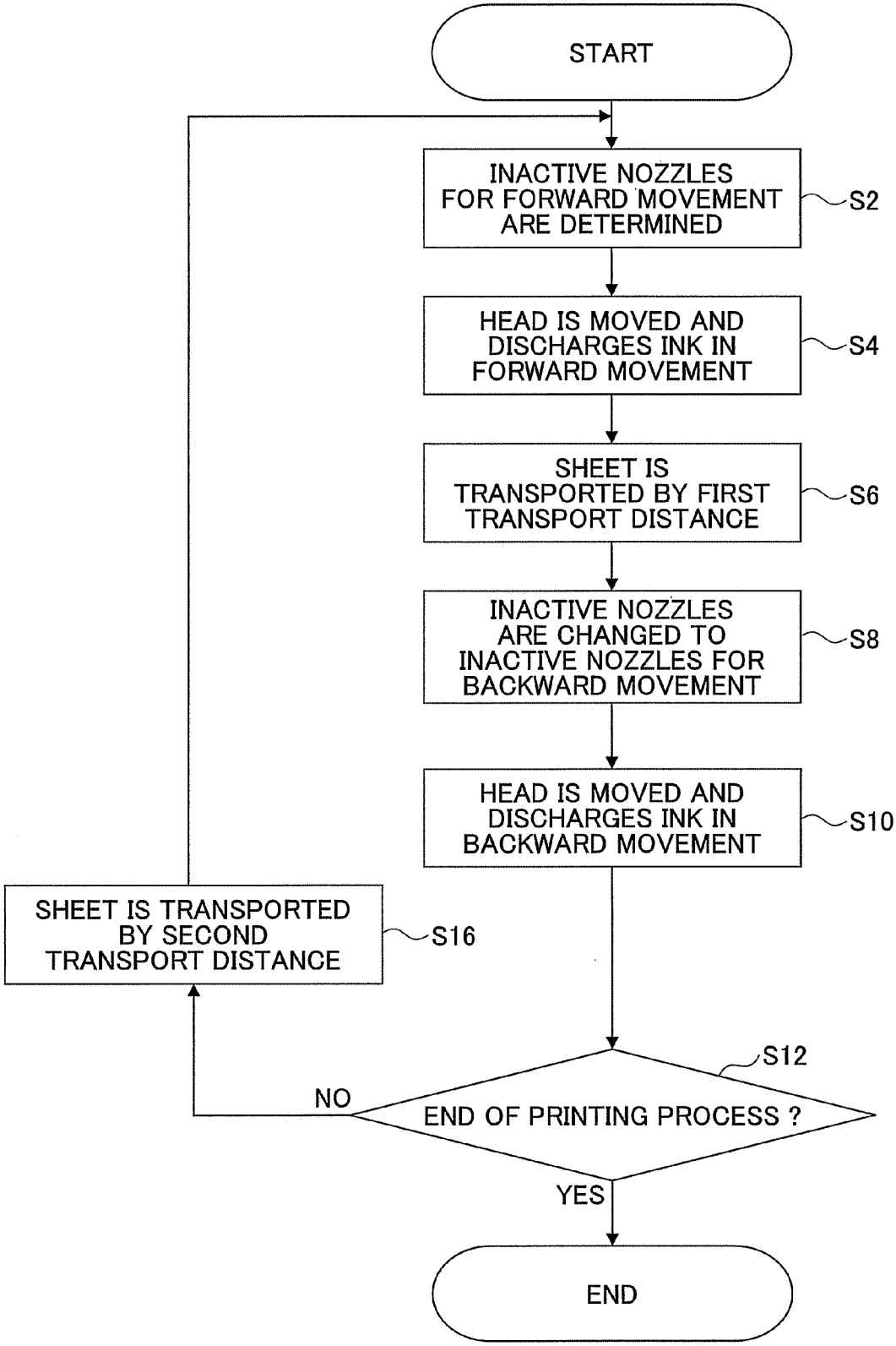
FIG. 13 is a flowchart for explaining a printing process which is performed by the control part of the image forming device of the present embodiment.

FIG. 13 is a flowchart for explaining a printing process which is performed by the control part of the image forming device of this embodiment. FIGS. 14-21 are diagrams for explaining a typical printing procedure by the printing head of this embodiment.

For the sake of convenience of description, it is assumed in FIGS. 14-21 that the printing procedure is performed to a recording sheet 3 by using the two printing heads 14*y* and 14*m* (refer to FIG. 3A and FIG. 3B) of the printing head 14 of this embodiment. In FIGS. 14-21, "○" ("◇") or "●" ("◆") denotes a nozzle 14*n* of the printing head 14*m* of magenta, and "Δ" ("□") or "▲" ("■") denotes a nozzle 14*n* of the printing head 14*y* of yellow. "○" ("◇") and "Δ" ("□") denote the nozzles that do not discharge the ink (which will be referred to as "inactive nozzles"), and "●" ("◆") and "▲" ("■") denotes the nozzles that discharge the ink (which will be referred to as "active nozzles").

Changing of the inactive nozzles (or the active nozzles) among the nozzles 14*n* of the printing head 14*y* or the printing head 14*m* is carried out by the nozzle changing part 1014.

In the following, one of a plurality of small rectangles of a grid-like pattern in each of FIGS. 14-21 will be called "cell". In each of FIGS. 14-21, a schematic illustration of the recording sheet 3 is provided in the center of the grid-like pattern. It is assumed that the movement of the printing head 14 along a forward path from the left-hand side to the right-hand side is a forward movement, and the movement of the printing head 14 along a backward path from the right-hand side to the left-hand side is a backward movement. In the case of FIGS. 14-21, it is assumed that image formation is performed to the recording sheet 3 by making two scans of the printing head 14 over the recording sheet 3. For this reason, two adjacent ones of the nozzles arrayed in one row of each of the printing heads 14*y* and 14*m* are spaced apart from each other by one cell along the nozzle row. The impact sequence of ink drops is indicated in two rows on the top of the recording sheet 3, but the two rows correspond to one row of ink dots in a printing area of the recording sheet 3. Namely, an ink drop with the impact sequence "1" and an ink drop with the impact sequence "2" reach and permeate the recording sheet 3 in this order in a superimposing manner, so that the two ink drops form one dot on the recording sheet 3 as illustrated in FIG. 8C.

Figure 14:
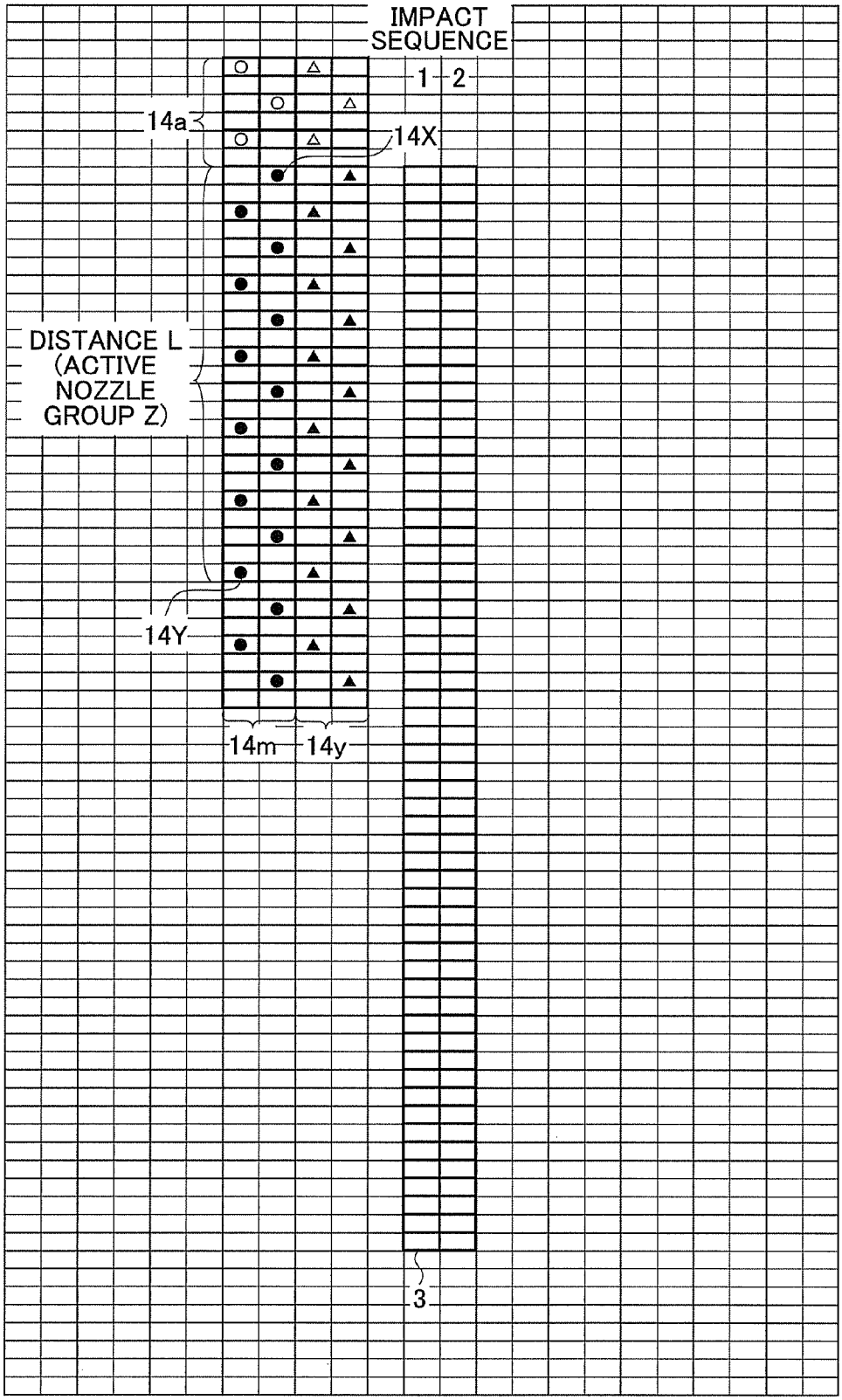
FIG. 14 is a diagram for explaining a typical printing procedure by a printing head of the present embodiment.

As illustrated in FIG. 13 and FIG. 14, the nozzle changing part 1014 (refer to FIG. 12) determines the inactive nozzles among the nozzles 14*n* of the printing head 14 for the forward movement (step S2). In other words, the nozzle changing part 1014 determines the active nozzles among the nozzles 14*n* of the printing head.

In the example of FIG. 14, the nozzles at an end portion 14*a* of each of the printing heads 14*y* and 14*m* are determined as the inactive nozzles, and other nozzles of each of the printing heads 14*y* and 14*m* are determined as the active nozzles. The inactive nozzles at the end portion 14*a* may be one nozzle, or may be two or more nozzles. The method of determination of the number of the inactive nozzles will be described later.

In the example of FIG. 14, both the number of the inactive nozzles of the printing head 14*y* and the number of the inactive nozzles of the printing head 14*m* are determined as being three.

Figure 15:
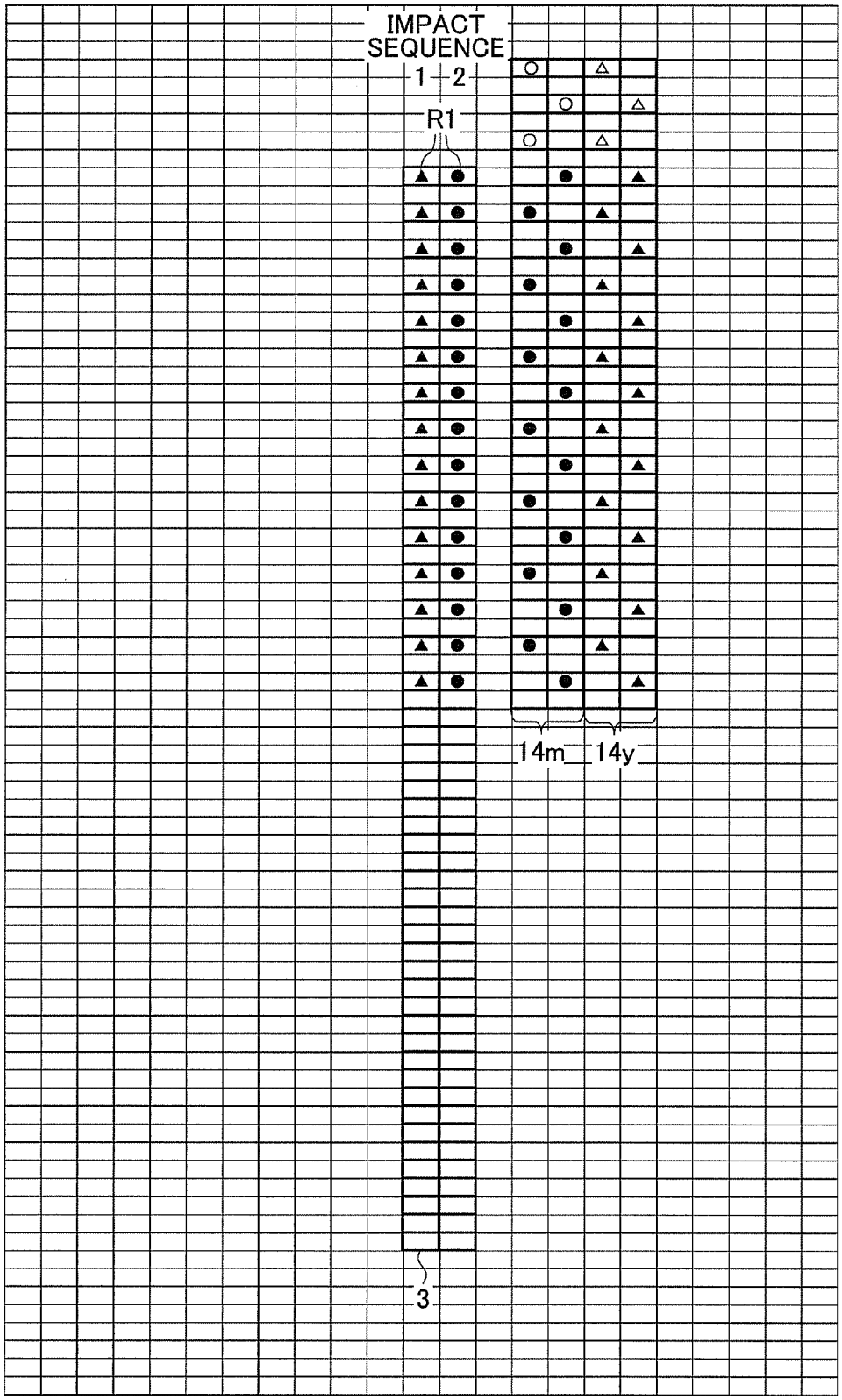
FIG. 15 is a diagram for explaining the printing procedure by the printing head of the present embodiment.

Subsequently, the printing head 14 is moved along the forward path parallel to the main scanning direction. When the printing head 14 passes through the upper part of the recording sheet 3, the printing head 14 discharges the ink as illustrated in FIG. 15 (step S4). Because the printing head 14*y* is located on the front side in the head moving direction of the printing head 14, the ink drop of yellow reaches the recording sheet earlier than the ink drop of magenta. The first "1" in the impact sequence of ink dots is yellow (▲) and the second "2" is magenta (●). In this manner, in the printing procedure in FIGS. 14-21, the ink drops from one of the printing heads 14*y* and 14*m* of the printing head 14 located on the front side in the head moving direction reach the recording sheet earlier than the ink drops from the other of the printing heads 14*y* and 14*m*. Because of the previously described phenomenon, the ink dots of red R1 in which yellow is dominant are formed in the recording sheet 3 by the first scan.

Figure 16:
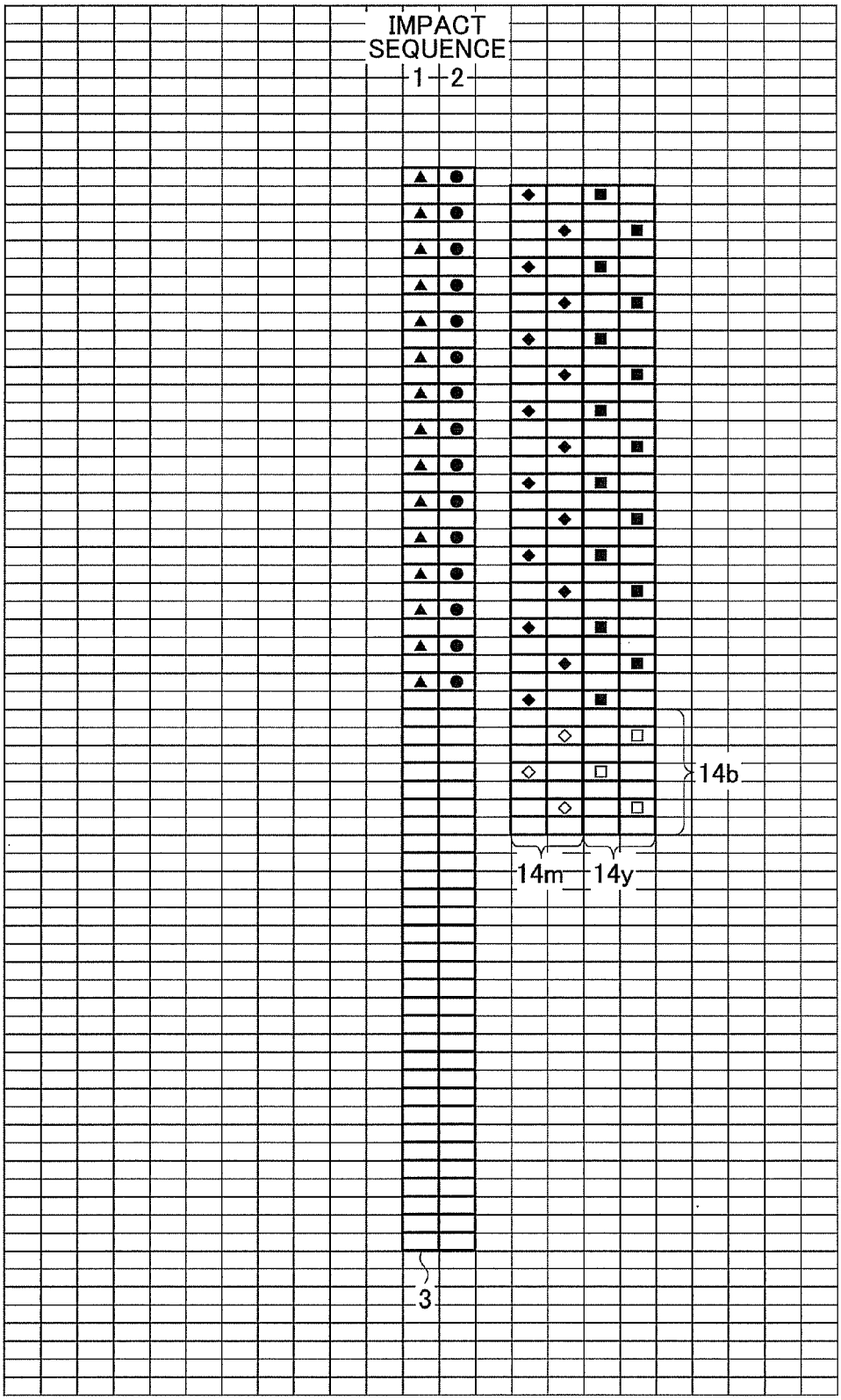
FIG. 16 is a diagram for explaining the printing procedure by the printing head of the present embodiment.

After the forward movement of the printing head 14 is performed, the distance changing part 1012 causes the sub-scan motor drive part 113 (refer to FIG. 6) to transport the recording sheet 3 in the sub-scanning direction by a first transport distance as illustrated in FIG. 16 (step S6). It is preferred that the first transport distance is set to a minimum sheet transport distance of the recording sheet 3 which is predetermined for transporting the recording sheet 3. With the first transport distance being set to the minimum sheet transport distance, the number of the inactive nozzles among the nozzles 14*n* of the printing head 14 can be reduced and a largest possible number of the nozzles among the nozzles 14*n* of the printing head 14 can be used. The minimum sheet transport distance is a shortest possible distance by which the transporting device (transporting belt 33) can transport the recording sheet 3. A specific value of the minimum sheet transport distance may be predetermined for each of the image forming device models. For example, the value of the minimum sheet transport distance predetermined for the image forming device of this embodiment is set to 0.3 mm.

In practice, the recording sheet 3 is transported in the sub-scanning direction and the printing head 14 is not moved in the sub-scanning direction. However, in order to show the positional relationship of the printing head 14 relative to the recording sheet 3, it is illustrated in FIG. 16 as if the printing head 14 was moved in the sub-scanning direction. Specifically, the printing head 14 as illustrated in FIG. 15 is moved downward by the first transport distance corresponding to seven cells to the location of the printing head 14 as illustrated in FIG. 16.

The nozzle changing part 1014 changes the inactive nozzles 14*a* (which do not discharge the ink) determined for the forward movement to the inactive nozzles (which do not discharge the ink) for the backward movement (step S8). The changing of the inactive nozzles is performed by the nozzle changing part 1014 alternately for one of the forward movement and the backward movement so that the impact sequence of ink dots for every scan remains unchanged.

In the step S8, the nozzle changing part 1014 determines the nozzles at an end portion 14*b* of each of the printing heads 14*y* and 14*m* as being the inactive nozzles for the backward movement. The number of the inactive nozzles for both the printing heads 14*y* and 14*m* in this case is three. It is preferred that the number of the inactive nozzles for the forward movement and the number of the inactive nozzles for the backward movement are equal to each other.

In the present embodiment, the step S6 is performed earlier than the step S8. Alternatively, the step S8 may be performed earlier than the step S6, or the step S6 and the step S8 may be performed simultaneously.

In FIG. 16, "◇" or "◆" denotes a nozzle 14*n* of the printing head 14*m* of magenta (which is the same as "○" or "●"), and "□" or "■" denotes a nozzle 14*n* of the printing head 14*y* of yellow (which is the same as "Δ" or "▲").

Subsequently, the printing head 14 is moved along the backward path parallel to the main scanning direction (backward movement). When the printing head 14 passes through the upper part of the recording sheet 3, the printing head 14 discharges the ink as illustrated in FIG. 17 (step S10).

At this time, the first "1" in the impact sequence of ink dots is magenta (◆) and the second "2" in the impact sequence of ink dots is yellow (■). Because of the previously described phenomenon, the ink dots of red R2 in which magenta is dominant are formed on the recording sheet 3 by the second scan of the printing head 14.

Figure 17:
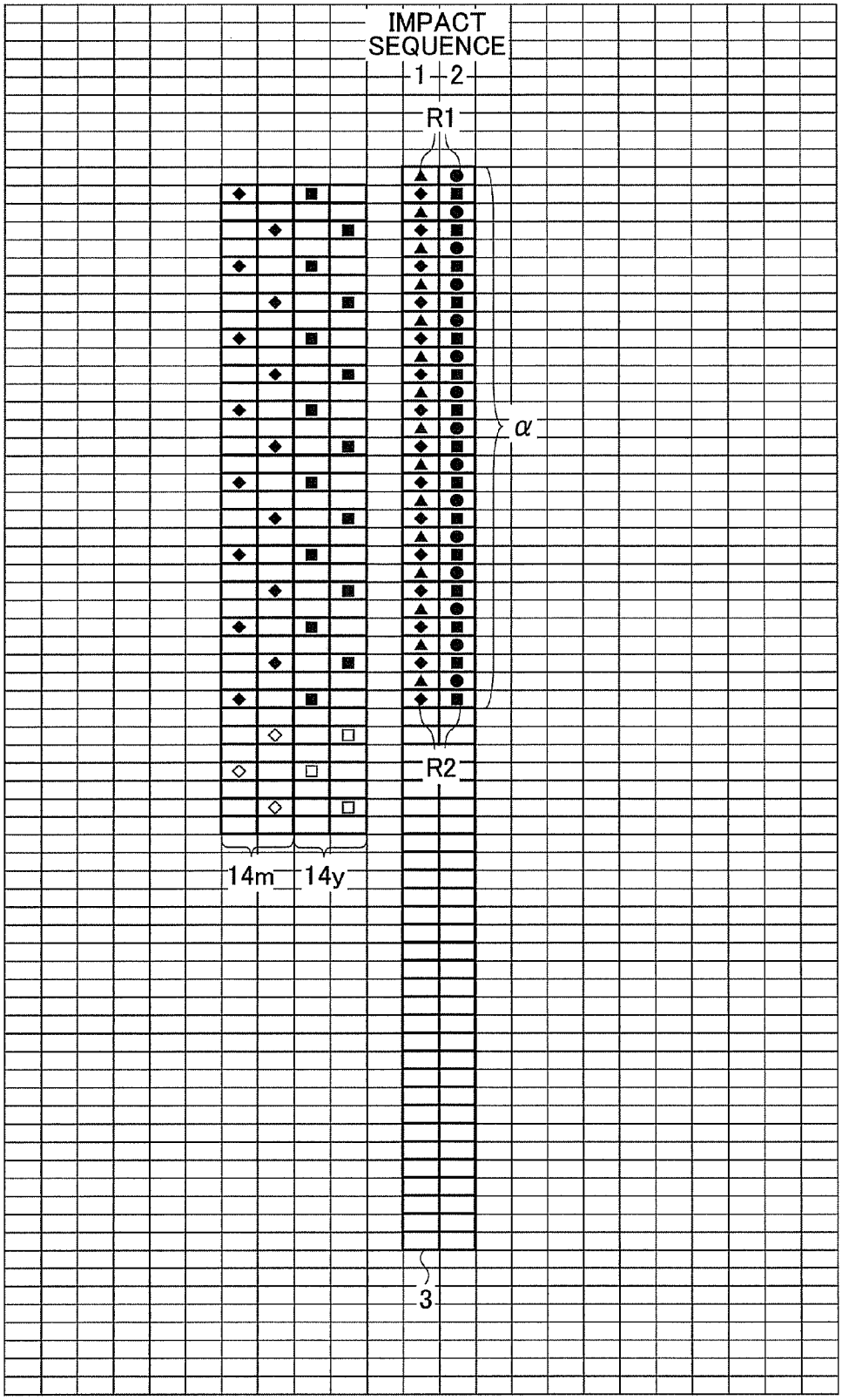
FIG. 17 is a diagram for explaining the printing procedure by the printing head of the present embodiment.

In the recording sheet 3 illustrated in FIG. 17, the ink dots of red R1 in which yellow is dominant and the ink dots of red R2 in which magenta is dominant are alternately formed along the sub-scanning direction. However, because one dot is negligibly small to the human eyes, it is recognized that these dots are of monochrome red.

Figure 18:
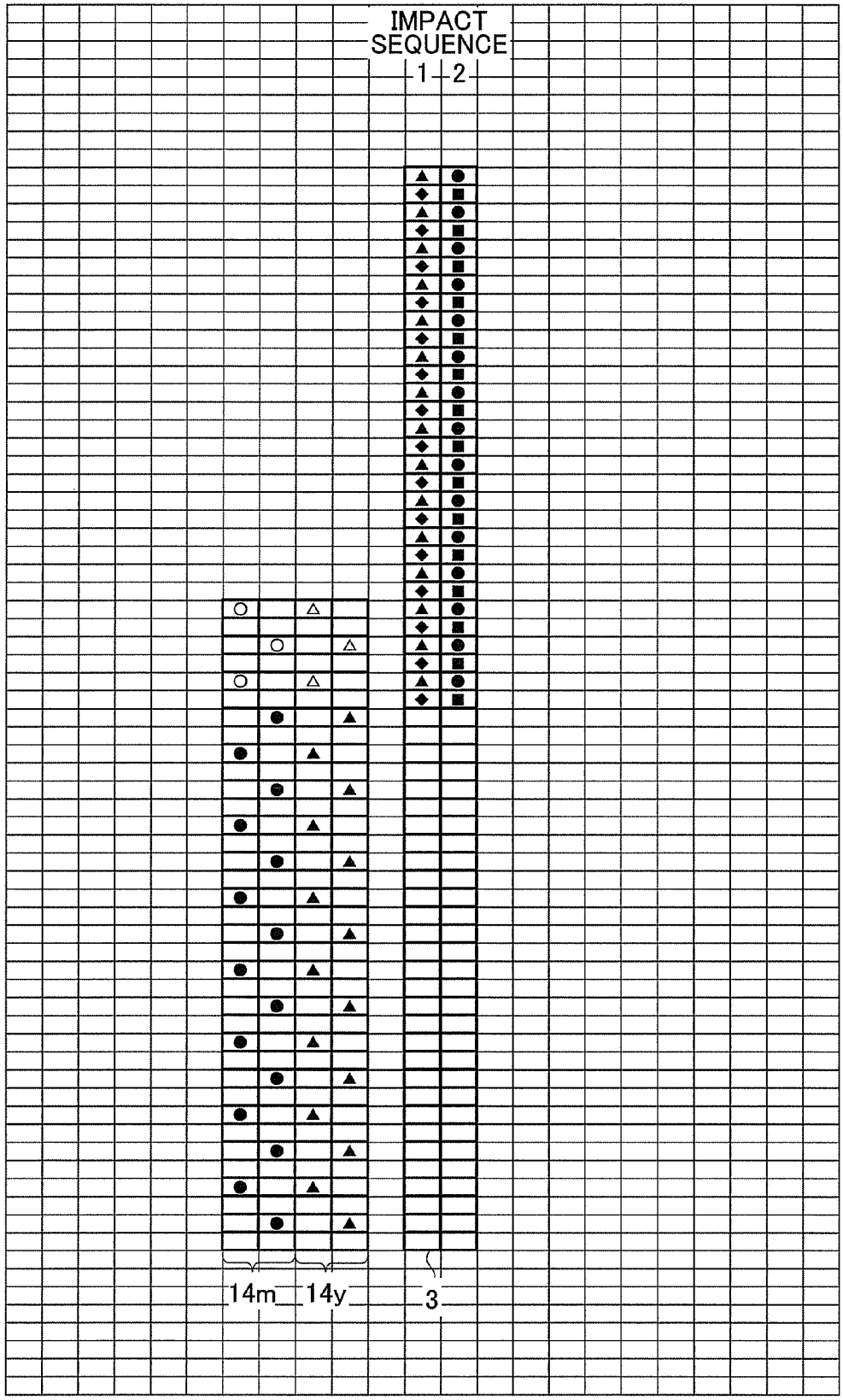
FIG. 18 is a diagram for explaining the printing procedure by the printing head of the present embodiment.

After the backward movement of the printing head 14 is performed, the CPU 101 determines whether the whole printing process is terminated (step S12). When it is determined in step S12 that the whole printing process is not terminated, the distance changing part 1012 causes the sub-scan motor drive part 113 (FIG. 6) to transport the recording sheet 3 in the sub-scanning direction by a second transport distance (not by the first transport distance) as illustrated in FIG. 18 (step S16). In other words, the distance changing part 1012 changes the sheet transporting distance for transporting the recording sheet after the backward movement of the printing head 14, to the second transport distance rather than the previously determined first transport distance.

It is preferred that the second transport distance is set to a total distance in the nozzle array direction between a first end nozzle and a second end nozzle of the active nozzles, having discharged the ink in the forward and backward movements of the printing head 14. More specifically, it is preferred that the second transport distance is set to a total distance L (as indicated in FIG. 14) in the nozzle array direction from a first end nozzle "14X" at one end of the group of the active nozzles (active nozzle group Z) having discharged the ink in both the forward movement and the backward movement of the printing head 14 to a second end nozzle "14Y" at the opposite end of the active nozzle group Z. In other words, the second transport distance is set to a total distance of the active nozzles having discharged the ink in the nozzle array direction. In the present example, the total distance L of the active nozzle group Z as illustrated in FIG. 14 (the second transport distance) is equal to a distance corresponding to 23 cells.

Subsequently, the control is shifted to the step S2. In the step S2, the nozzle changing part 1014 determines the inactive nozzles among the nozzles 14*n* of the printing head 14 for the forward movement. In this case, the three nozzles at the end portion 14*a* of each of the printing heads 14*m* and 14*y* of the printing head 14 are determined as the inactive nozzles similar to the case of FIG. 14 as illustrated in FIG. 18.

Figure 19:
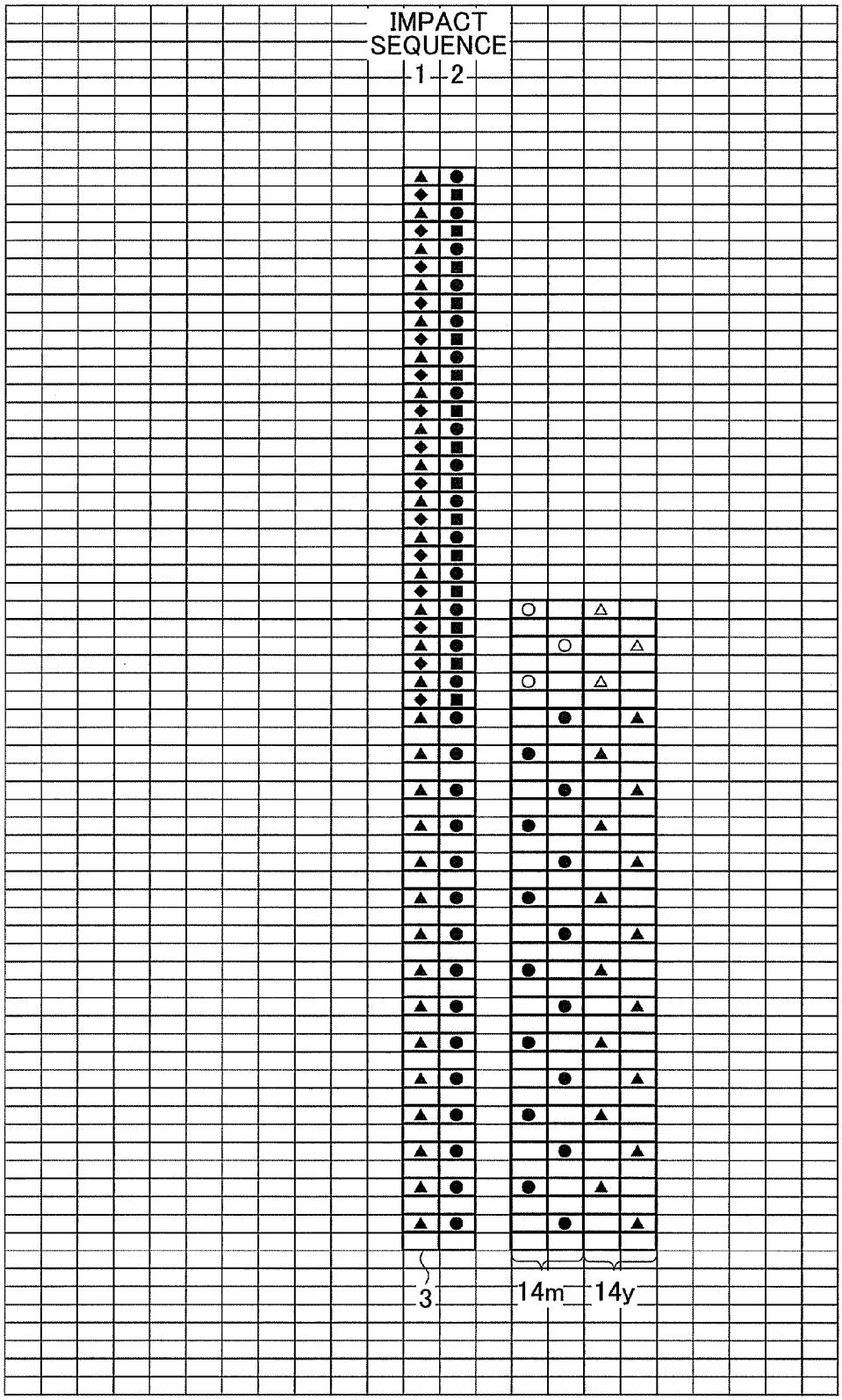
FIG. 19 is a diagram for explaining the printing procedure by the printing head of the present embodiment.

Subsequently, as illustrated in FIG. 19, the printing head 14 is moved along the forward path parallel to the main scanning direction, and when the printing head 14 passes through the upper part of the recording sheet 3, the printing head 14 discharges the ink (step S4).

Figure 20:
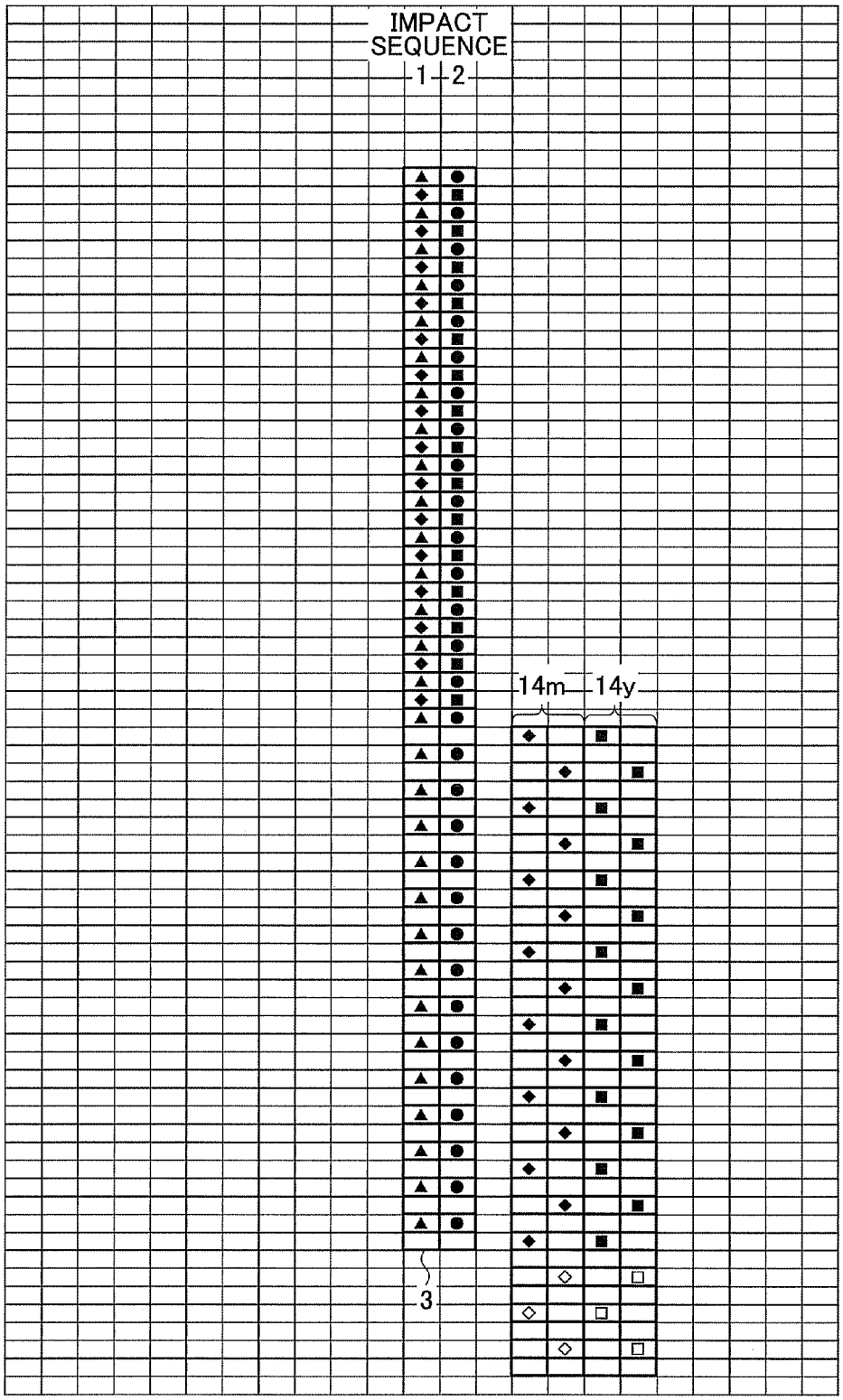
FIG. 20 is a diagram for explaining the printing procedure by the printing head of the present embodiment.

Subsequently, as illustrated in FIG. 20, the distance changing part 1012 causes the sub-scan motor drive part 113 to transport the recording sheet 3 by the first transport distance (or the minimum sheet transport distance) (step S6), and the nozzle changing part 1014 changes the inactive nozzles among the nozzles 14*n* of the printing head 14 for the backward movement (step S8).

Figure 21:
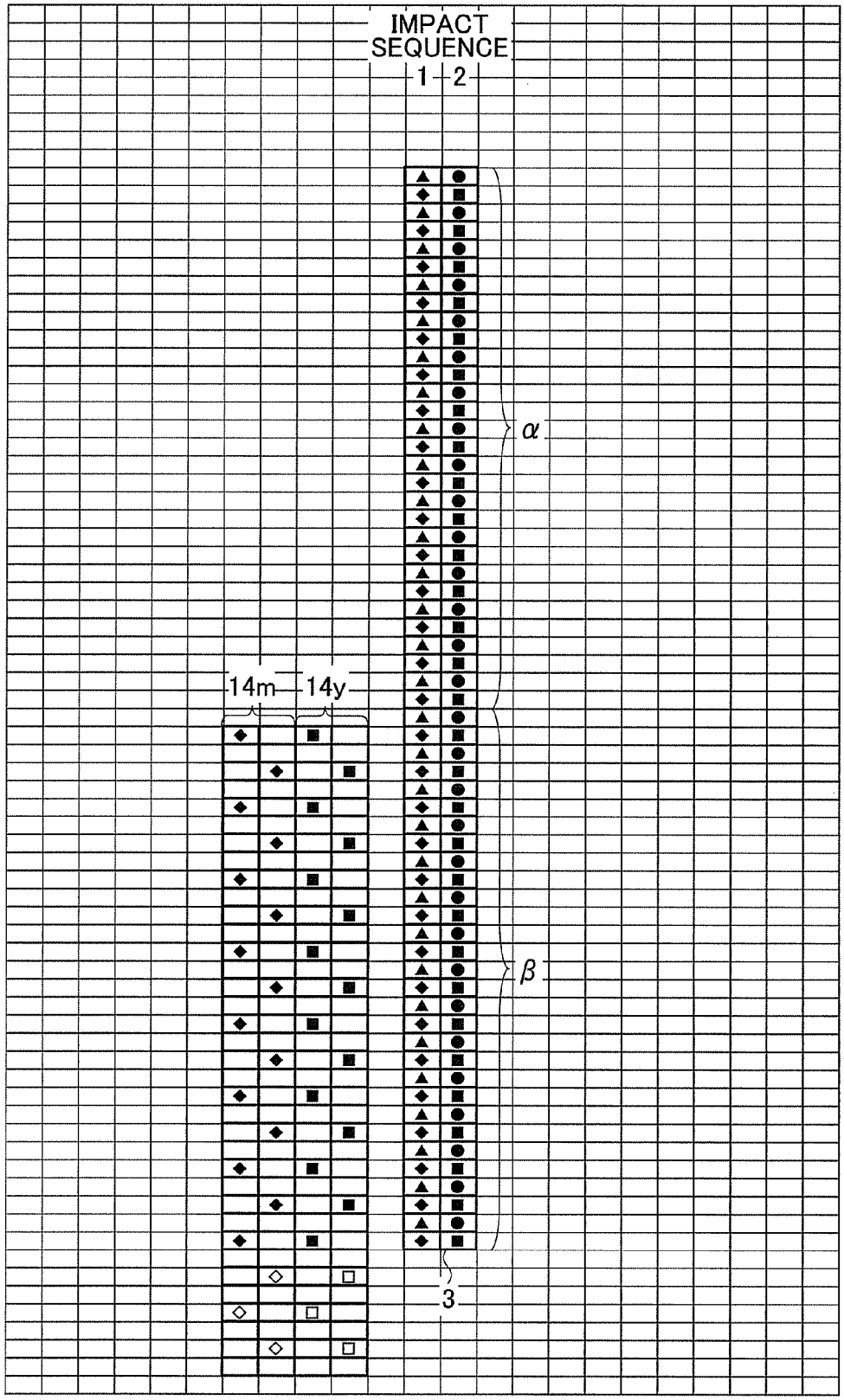
FIG. 21 is a diagram for explaining the printing procedure by the printing head of the present embodiment.

Subsequently, as illustrated in FIG. 21, the printing head 14 is moved along the backward path parallel to the main scanning direction, and when the printing head 14 passes through the upper part of the recording sheet 3, the printing head 14 discharges the ink.

When the CPU 101 determines in the step S12 that the whole printing process is terminated, the printing process of FIG. 13 is terminated.

As described above, in the image forming device of this embodiment, the nozzle changing part 1014 determines the inactive nozzles among the nozzles 14*n* of the printing head 14 alternately for one of the forward movement and the backward movement so that the impact sequence of ink dots for every scan remains unchanged. The active nozzles in the printing head 14 for the forward movement differ from the active nozzles in the printing head 14 for the backward movement. When the printing head 14 is repeatedly moved forward and backward for multiple scans, the inactive nozzles (or the active nozzles) in the printing head 14 for the forward movement of every scan remain unchanged, and the inactive nozzles (or the active nozzles) in the printing head 14 for the backward movement of every scan remain unchanged.

In the image forming device of this embodiment, the distance changing part 1012 changes the sheet transporting distance by which the recording sheet 3 is to be transported after the forward movement of the printing head 14, to the first transport distance, and changes the sheet transporting distance by which the recording sheet is to be transported after the backward movement of printing head 14, to the second transport distance. The second transport distance differs from the first transport distance. When the printing head is repeatedly moved forward and backward for multiple scans, the first transport distance of the recording sheet 3 after the forward movement of the printing head 14 for every scan remains unchanged and the second transport distance of the recording sheet 3 after the backward movement of the printing head 14 for every scan remains unchanged.

In the present embodiment, the first transport distance of the recording sheet is set to the minimum sheet transport distance while the second transport distance of the recording sheet is set to the total distance L of the active nozzles having discharged the ink in the nozzle array direction. However, the present disclosure is not limited to this embodiment. Alternatively, the first transport distance of the recording sheet may be set to the total distance L of the active nozzles having discharged the ink in the nozzle array direction while the second transport distance of the recording sheet may be set to the minimum sheet transport distance.

In the example of FIGS. 14-21, the nozzles 14*n* of the printing head 14 are arranged in a staggered formation. However, the present disclosure is not limited to this embodiment. Alternatively, the nozzles 14*n* of the printing head 14 may be arranged in a straight-line formation or in any other formation. When the nozzles 14*n* of the printing head 14 are arranged in a straight-line formation, the nozzles may be arranged in two or more rows.

As described above, the image forming device of this embodiment includes the distance changing part 1012 and the nozzle changing part 1014, and makes it possible that the impact sequence of ink dots for every scan remains unchanged. Specifically, in the example of FIG. 21, both the ink dots of red formed by the first and second scans (the area indicated by α in FIG. 21) and the ink dots of red formed by the third and fourth scans (the area indicated by β in FIG. 21) are formed in the same sequence of "the ink dots of red R1 in which yellow is dominant→the ink dots of red R2 in which magenta is dominant". In this manner, when an image is formed by two scans, all the ink dots of red formed by the first and second scans, the third and fourth scans, the fifth and sixth scans, and . . . , respectively, are formed in the same impact sequence. In other words, each ink dot of red is formed in the recording sheet in the same impact sequence of ▲→●→◆→■. Similarly, other ink dots of different colors are formed in the recording sheet in the same impact sequence. Accordingly, the impact sequence of ink dots for every scan remains unchanged.

For the same reason, when an image is formed by "n" scans (where "n" is an integer equal to or greater than 3), all the ink dots of red formed by the first, second, . . . , and n-th scans, the (n+1)-th, (n+2)-th, . . . and 2n-th scans, the (2n+1)-th, (2n+2)-th, . . . and 3n-th scans, . . . , respectively, are formed in the same impact sequence.

Accordingly, even when an impact position error arises (as in FIG. 11) and the ink dot of red R1 and the ink dot of red R2 are mixed, the ink dot of red R1 is formed in the recording sheet earlier than the ink dot of red R2, and an ink dot in which red R1 is dominant is always formed. Hence, color banding does not occur but a uniform image can be formed. In the image forming device of the present embodiment, the printing head in which the nozzles are arranged in either a staggered formation or a straight-line formation may be used. Therefore, the image forming device of the present embodiment can efficiently eliminate color banding in the bidirectional printing using a simple printing head structure.

In the image forming device of this embodiment, the nozzle changing part 1014 determines the nozzles at one end portion 14*a* of the printing head 14 as being the inactive nozzles in the printing head 14 for the forward movement, and determines the nozzles at the other end portion 14*b* of the printing head 14 as being the inactive nozzles in the printing head 14 for the backward movement.

Generally speaking, nozzles of a printing head at its end portions in many cases may be poor in the accuracy of ink discharge. In the present embodiment, the nozzles at the end portions 14*a* and 14*b* of the printing head 14 are used as the inactive nozzles which do not discharge ink, and with the use of such inactive nozzles, it is possible to prevent the deterioration of the accuracy of ink discharge.

Next, the method of determination of the number of the inactive nozzles will be described.

In the following, "A" denotes the number of inactive nozzles (which do not discharge ink) in the printing head, "P" denotes a predetermined resolution of nozzles of the printing head, "Q" denotes a predetermined resolution of image formation of the image forming device, "a" denotes a predetermined minimum sheet transport distance, and "X" denotes the number of scans needed for image formation on a recording sheet.

The minimum sheet transport distance "a" is represented by the following formula.

$$a=(A+(1/X))\times P \quad (1)$$

The number "X" of scans needed for image formation is represented by the following formula.

$$X=Q/P \quad (2)$$

Substituting the formula (2) into the formula (1) yields the following formulas.

$$A=(a/P)-(P/Q) \quad (3)$$

In the image forming device of the present embodiment, the number "A" of the inactive nozzles is computed beforehand in accordance with the above formula (3), the number "A" of the inactive nozzles is stored in, for example, the ROM 102 (FIG. 6), and the nozzle changing part 1014 is arranged to read out the number "A" of the inactive nozzles from the ROM 102 and use the number "A" when performing the changing of the inactive nozzles among the nozzles of the printing head.

Next, an image forming device of another embodiment of the present disclosure will be described.

The image forming device of the present embodiment is arranged so that the control part uses the error measuring part 1016 and the instructions part 1018 as illustrated in FIG. 12, in addition to the distance changing part 1012 and the nozzle changing part 1014.

In the present embodiment, the error measuring part 1016 measures an impact position error of ink (which is a difference between the ideal impact position illustrated in FIG. 10 and the actual impact position illustrated in FIG. 11). The instructions part 1018 compares the measured error from the error measuring part 1016 with a predetermined reference value.

When the measured error is larger than the reference value, the instructions part 1018 outputs instructions for causing the distance changing part 1012 to perform changing of the sheet transporting distance to one of the first transport distance and the second transport distance and for causing the nozzle changing part 1014 to determine the inactive nozzles among the nozzles 14*n* of the printing head 14 alternately for one of the forward movement and the backward movement so that the impact sequence of ink dots for every scan remains unchanged.

When the measured error is less than the reference value, the instructions part 1018 does not output the above-described instructions to the distance changing part 1012 and the nozzle changing part 1014 and causes the image forming device to perform image formation on a recording sheet by using the existing image forming method according to the related art.

In the image forming device of the present embodiment, when a measured impact position error is larger than the reference value, the distance changing part 1012 and the nozzle changing part 1014 are activated to carry out the printing process as illustrated in FIG. 13. Namely, when the measured impact position error is larger than the reference value, the distance changing part 1012 performs changing of the sheet transporting distance to one of the first transport distance and the second transport distance and the nozzle changing part 1014 determines the inactive nozzles among the nozzles 14*n* of the printing head 14 alternately for one of the forward movement and the backward movement. On the other hand, when the measured impact position error is less than the reference value, the distance changing part 1012 and the nozzle changing part 1014 are not activated and the image forming device performs image formation on a recording sheet by using the existing image forming method according to the related art.

It is preferred that a measuring process for measuring an impact position error is performed by the error measuring part 1016 prior to a start of a printing process (image formation processing). Alternatively, such an impact position error on a recording sheet may be detected by visual inspection of a user without using the error measuring part 1016 and the instructions part 1018. When the impact position error is visually detected, the user may activate the distance changing part 1012 and the nozzle changing part 1014 to carry out the printing process as illustrated in FIG. 13. In this case, the user on the operation panel 117 may input a signal indicating that the impact position error has been detected. The distance changing part 1012 and the nozzle changing part 1014 may be arranged to carry out the printing process of FIG. 13 in response to the signal received from the operation panel 117.

According to the image forming device and the image forming method of the present disclosure, it is possible to efficiently eliminate color banding in the bidirectional printing using a simple printing head structure.

The present disclosure is not limited to the above-described embodiments, and variations and modifications may be made without departing from the scope of the present disclosure.

The present application is based on Japanese patent application No. 2009-251037, filed on Oct. 30, 2009, the contents of which are incorporated herein by reference in their entirety.

What is claimed is:

1. An image forming device which forms an image on a recording sheet by bidirectional recording, comprising:

a sheet transporting device that transports a recording sheet in a sheet transporting direction;

a recording head including multiple head units of different colors, each head unit having nozzles arranged to discharge a recording liquid of one of the colors;

a head moving device that moves the recording head along a forward path and a backward path parallel to a direction perpendicular to the sheet transporting direction to form an image on the recording sheet using some of the nozzles of each head unit of the recording head; and a control part that controls the image forming device, the control part comprising:

a distance changing part configured to change a sheet transporting distance for transporting the recording sheet after a forward movement of the recording head to a first transport distance and configured to change a sheet transporting distance for transporting the recording sheet after a backward movement of the recording head to a second transport distance, said second transport distance being different from the first transport distance; and a nozzle changing part configured to determine inactive nozzles which do not discharge the recording liquid, among the nozzles of the recording head alternately for one of the forward movement and the backward movement of the recording head, where the distance changing part is configured so that one of the first transport distance and the second transport distance is set to a predetermined minimum sheet transport distance.

2. The image forming device according to claim 1, wherein the distance changing part is configured so that the other of the first transport distance and the second transport distance is set to a total distance in a nozzle array direction of active nozzles of the recording head having discharged the ink in both the forward movement and the backward movement.

3. The image forming device according to claim 1, wherein the nozzle changing part is configured so that nozzles located in an end portion of the recording head are determined as being the inactive nozzles which do not discharge the recording liquid.

4. The image forming device according to claim 1, wherein the nozzle changing part is configured so that the number A of the inactive nozzles is determined in accordance with the formula: $A=(a/P)-(P/Q)$ where a denotes a predetermined minimum sheet transport distance, P denotes a predetermined resolution of the nozzles of the recording head, and Q denotes a predetermined resolution of image formation of the image forming device.

5. The image forming device according to claim 1, further comprising:

an error measuring part configured to measure an impact position error on the recording sheet; and an instructions part configured to cause the distance changing part and the nozzle changing part to operate when the measured error is larger than a predetermined reference value.

6. The image forming device according to claim 1, further comprising:

an input part configured to input a signal indicating that an impact position error on the recording sheet is detected; and an instructions part configured to cause the distance changing part and the nozzle changing part to operate in response to the signal from the input part.

7. An image forming method for use in an image forming device having a recording head including multiple head units of different colors, each head unit having nozzles arranged to discharge a recording liquid of one of the colors, the image forming device moving the recording head along a forward path and a backward path parallel to a direction perpendicular to a transporting direction of a recording sheet while transporting the recording sheet in the sheet transporting direction to form an image on the recording sheet using some of the nozzles of the recording head, the image forming method comprising:

determining, among the nozzles of the recording head, inactive nozzles which do not discharge the recording liquid for a forward movement of the recording head;

transporting the recording sheet by a first transport distance after the forward movement of the recording head;

changing the inactive nozzles determined for the forward movement of the recording head to inactive nozzles which do not discharge the recording liquid for a backward movement of the recording head; and transporting the recording sheet by a second transport distance after the backward movement of the recording head, said second transport distance being different from the first transport distance, where one of the first transport distance and the second transport distance is set to a predetermined minimum sheet transport distance.

* * * * *